US008386345B2

(12) United States Patent
Tadepalli et al.

(10) Patent No.: US 8,386,345 B2
(45) Date of Patent: Feb. 26, 2013

(54) METHOD AND SYSTEM FOR GENERATING INVOICES WITH ENTITLEMENTS

(75) Inventors: Sridhar Tadepalli, Richmond, CA (US); Thomas W. Bowe, Jr., Pleasanton, CA (US); Sundar Rajagopalan, Emeryville, CA (US)

(73) Assignee: Siebel Systems, Inc., San Mateo, CA (US)

( * ) Notice: Subject to any disclaimer, the term of this patent is extended or adjusted under 35 U.S.C. 154(b) by 2618 days.

(21) Appl. No.: 10/299,426

(22) Filed: Nov. 18, 2002

(65) Prior Publication Data

US 2007/0214068 A1 Sep. 13, 2007

Related U.S. Application Data

(63) Continuation of application No. 09/967,879, filed on Sep. 28, 2001, now abandoned.

(51) Int. Cl.
*G07F 19/00* (2006.01)

(52) U.S. Cl. ..... 705/34; 705/30; 705/400

(58) Field of Classification Search ..... None
See application file for complete search history.

(56) References Cited

U.S. PATENT DOCUMENTS 5,377,095 A * 12/1994 Maeda et al. ..... 705/10
5,852,812 A * 12/1998 Reeder ..... 705/39
5,956,698 A * 9/1999 Lacheze et al. ..... 705/34
6,070,155 A * 5/2000 Cherrington et al. ..... 705/400
6,882,986 B1 4/2005 Heinemann et al. ..... 705/40
2002/0198798 A1* 12/2002 Ludwig et al. ..... 705/35
2011/0040704 A1* 2/2011 Ekker et al. ..... 705/400

OTHER PUBLICATIONS

"Definition of subsciption", Webster's Third New International Dictionary, Unabridged , 1993.*

PIMCO Selects TenFold Revenue Manager ™ for Invoicing and Revenue Accounting, "PR Newsire", Apr. 24, 2000.*

* cited by examiner

*Primary Examiner* — M. Thein

(74) *Attorney, Agent, or Firm* — Campbell Stephenson LLP

(57) ABSTRACT

Techniques to generate invoices for "events" (e.g., activities, orders, and so on) and taking into account applicable entitlements. The events are for actions and/or transactions to be performed, and may be related to contracts having entitlements that may specify special pricing for the events. An entitlement may define what event items are covered (e.g., time, expenses, parts), and the amount that is covered and the applicable discounts for each event item. To generate invoices for the events, contracts applicable to the events are initially determined and any entitlements that cover the events are identified. An original invoice amount for each event may be initially determined based on a standard pricing scheme (e.g., based on standard Price and/or Rate Lists) for this type of event. A revised invoice amount and discounts (if any) may then be determined for the event based on the applicable entitlements (if any).

32 Claims, 19 Drawing Sheets

METHOD AND SYSTEM FOR GENERATING INVOICES WITH ENTITLEMENTS

BACKGROUND OF THE INVENTION

The present invention relates generally to computer processing, and more particularly to techniques to generate invoices with entitlements.

Contract management is a ubiquitous challenge faced by many industries and organizations. In many industries, complex products and/or services may be offered, and these offerings may be associated with complex pricing structures, entitlements, billing and service delivery requirements, and so on. Contracts of varying degrees of complexity and scope may then be created and used for these offerings.

In general, a contract may be drafted to include any number of terms, and each term may be drafted to cover any matter of importance between contracting parties. For example, a contract may define certain pricing structure, cover certain services, offer certain preventive maintenance, and so on. For each of these terms, the scope of coverage may be negotiated depending on various factors such as, for example, the parties to the contract, the price paid, and so on. Contracts may thus be viewed as comprising various types of unstructured information.

A contract may be drafted to include various entitlements, which are benefits to be received under the contract once it is executed. For example, an entitlement may cover certain preventive maintenance, provide free service and parts for a particular period of time, offer special pricing on certain products and services, and so on.

During the life of the contracts, various activities and/or orders may be generated based on service requests or some other means. For example, an activity may relate to installation, repair, or service of a particular equipment, a sale or lease of a particular product, and so on. Some of the activities may be covered by previously executed contracts, and may be entitled to the benefits (if any) provided by these contracts. Invoices may need to be generated for the activities either before or after their performance.

Various challenges are encountered in generating invoices for activities. For example, the activities may be entitled to receive special pricing under the entitlements from the applicable contracts. Moreover, a large number of activities may need invoicing, and the entitlements may vary widely in complexity and scope. The challenges often magnify as the complexity and/or the number of activities, contracts, and entitlements increase.

Thus, techniques that may be used to generate invoices with entitlements are highly desirable.

SUMMARY OF THE INVENTION

The invention provides techniques to generate invoices for "events" and taking into account applicable entitlements. The events (e.g., activities, orders, and so on) are for actions and/or transactions to be performed for service requests or some other communication. The events may also be related to contracts having entitlements that may specify special pricing for the events. An entitlement may define what event items are covered (e.g., labor, travel, parts, expenses, repairs, and so on), the amount that is covered for each event item, the applicable discounts for each event item, and so on.

To generate invoices for the events, contracts applicable to the events are initially determined and any entitlements that cover the events are identified. An (original) invoice amount for each event may be initially determined based on a standard pricing scheme for this type of event (e.g., based on a standard Price List and/or Rate List for that event type). A revised invoice amount may then be determined for the event based on the applicable entitlements (if any). Discounts may also be determined for the event (if applicable), and may be used to show the amount of savings obtained through the entitlements.

The entitlement-based invoice generation provides various advantages (e.g., supports complex pricing structures for contracts). The invoices may be generated periodically, as scheduled, when directed, and so on.

The invention provides methods, computer program products, and systems capable of implementing various aspects, embodiments, and features of the invention, as described in further detail below.

The foregoing, together with other aspects of this invention, will become more apparent when referring to the following specification, claims, and accompanying drawings.

DESCRIPTION OF THE SPECIFIC EMBODIMENTS

Figure 1:
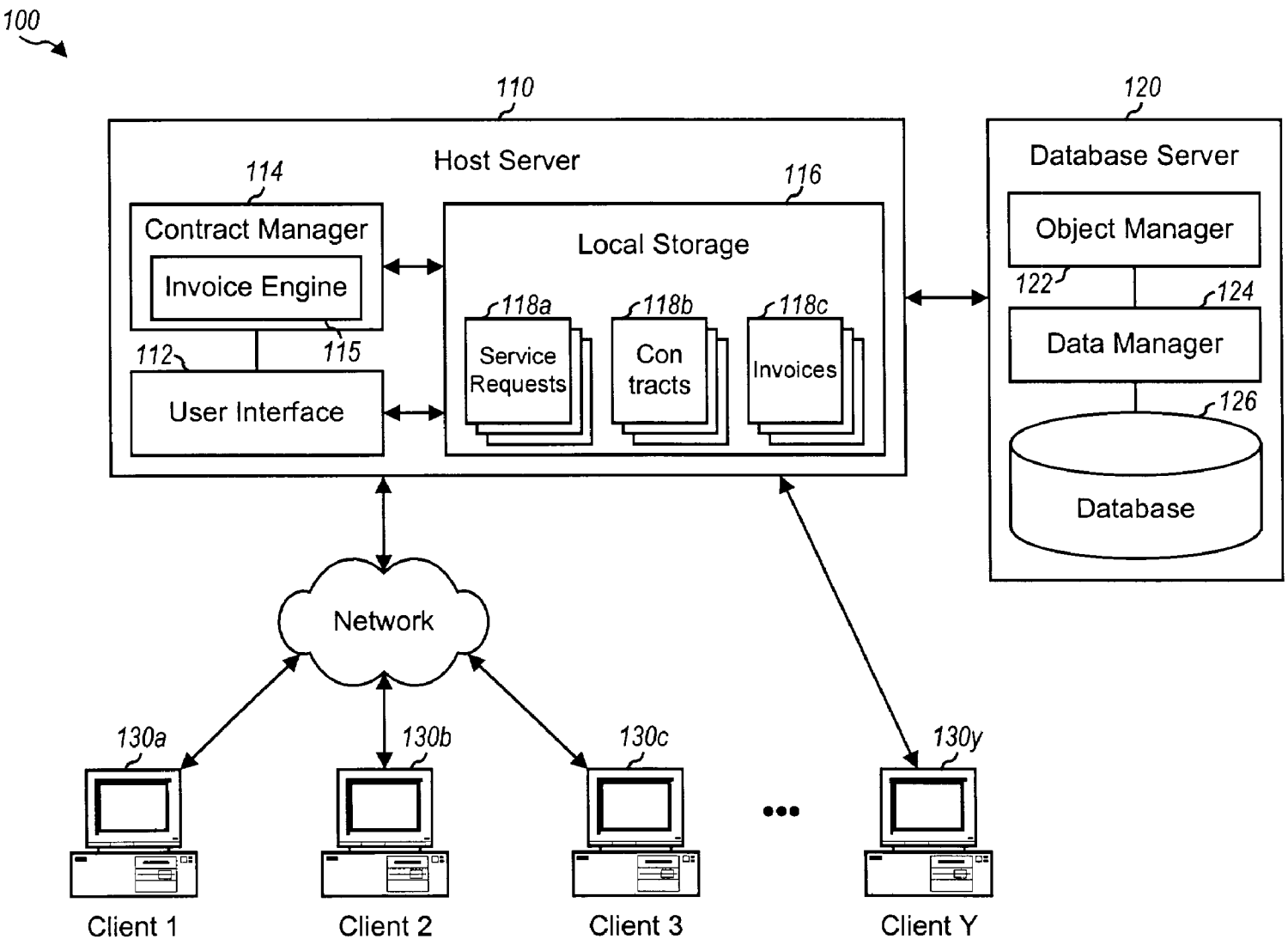
FIG. 1 is a diagram illustrating an embodiment of a contract management system.

FIG. 1 is a diagram illustrating a contract management system 100, in accordance with a specific embodiment of the invention. In this embodiment, contract management system 100 is implemented on a set of one or more host servers 110 that couple to and interact with one or more client computers 130 via direct connection, a computer network (e.g., the Internet), and/or some other means. Host server(s) 110 further couple to a database server 120 that stores data (typically in a "raw" form) used by the contract management system.

In an embodiment, contract management system 100 includes a number of modules such as a user interface module 112 and a contract manager 114. Additional, fewer, and/or different modules may also be included in contract management system 100, and this is within the scope of the invention.

User interface module 112 provides the interface (e.g., screens) used to present information to an administrator and/or an end-user of the contract management system. User interface module 112 further receives and interprets user commands and data, which may be provided via mouse clicks, mouse movements, keyboard inputs, and other means. User interface module 112 then provides the received data and commands to other modules, which then perform the appropriate responsive action.

Contract manager 114 facilitates the creation and management of contracts. Contract manager 114 receives requests to form contracts for various product and service offerings and, in response, provides the necessary screens, tools, templates, and data to support the creation of contracts, as described in U.S. patent application Ser. No. 09/967,895, entitled "Method and System for Instantiating Entitlements into Contracts" filed Sep. 28, 2001, assigned to the assignee of the present application and incorporated herein by reference. Contract manager 114 further includes an invoicing engine 115 that "services" agreements, e.g., by generating invoices for these agreements, as described in further detail in U.S. patent application Ser. No. 09/967,862, entitled "Method and System for Automatically Generating Invoices" filed Sep. 28, 2001, assigned to the assignee of the present application and incorporated herein by reference. Invoicing engine 115 may further generate invoices for events by taking into account applicable entitlements, as described in further detail below.

The modules within contract management system 100 may operate on and share the data stored in a central database 126. Typically, raw data from database 126 is retrieved by a module within contract management system 100 and processed into a form more suitable for that module. The processed data is then stored to a local storage 116 to allow for fast and efficient access to the data. In an embodiment, service requests 118*a* with "events" (e.g., activities and orders) to be invoiced, contracts 118*b* that include entitlements for the service requests and events, and invoices 118*c* may be stored in local storage 116. Local storage 116 may be implemented with a semiconductor memory (e.g., RAM, Flash), a hard disk, or some other data storage technology that can provide fast access to the data stored thereon.

In an embodiment, database server 120 manages the central database for contract management system 100 and includes an object manager 122, a data manager 124, and database 126. Object manager 122 manages the interaction with the database and, in an embodiment, includes business objects (BO), business services (BS), and business components (BC) (not shown in FIG. 1 for simplicity). The business objects model major entities (e.g., contracts, service requests, invoices, and so on) in the contract management system with associated business rules. Each business object is made up of a hierarchy of parent-child components, which model relationship with appropriate specialized operations. The business services are the basic components for building complex behavior. New business services may be created and linked into multi-step control flows to provide complex behavior encompassing multiple business objects. The business components provide real time access to remote objects without replication of data within database 126. A business object may be made up of a number of business components managed by the contract management system.

Data manager 124 manages database 126 and performs this function by invoking SQL objects. Database 126 stores data for the contract management system, and possibly for other systems that may be combined with the contract management system to provide the overall system.

Contract management system 100 provides screens and tools to (1) support efficient creation of contracts, (2) organize and display contracts, (3) manage and service executed contracts, and (4) generate invoices for events that may be related to the contracts. Contract management system 100 may be used for numerous industries and organizations. For example, contract management system 100 may be used for organizations that provide services, offer rentals, sell products, provide leasing or financing, manage resources, and so on.

As used herein, a contract is document that defines the business relationship between contracting parties. A contract may be complex and typically describes the obligations to perform, provide, sell, offer, or produce specific activities, responsibilities, products, or services over a determined period of time for a specific amount of money. A contract may cover sales of goods, services, or a combination of both. A contract typically includes detailed descriptions of pricing, terms, limitations, coverage, conditions, legal rights, extension clauses, and other guidelines. A contract can thus include various types of unstructured information. As used herein, an agreement is an executed contract, and the term "contract" may generically refer to an executed contract (i.e., an agreement) or an unexecuted contract.

The invention provides techniques to generate invoices for events and taking into account applicable entitlements. The entitlement-based invoice generation supports complex pricing structures, which may increase revenue and profitability for an organization while at the same time reduce operational costs. The entitlement-based invoice generation can further minimize errors and provide various other advantages.

In an aspect, pricing terms for a contract may be defined by an entitlement. The entitlement may define what event items are covered (e.g., labor, travel, parts, expenses, repairs, and so on), the amount that is covered for each event item, the discounts applicable for each event item, and so on. The amount may be determined, for example, as a percentage over cost, a percentage below a base cost, a fixed amount, some other amount, or a combination thereof.

As an example, a contract may specify a 70% discount on parts with a maximum discount of $600. In response to a service request, a field service personnel installs a laser drum at a customer site. The total time and expense costs for the installation is $1000 and the parts cost is $1300. The total charges for the service activity, without entitlement, would be $2300 (i.e., $1000+$1300).

With the inventive techniques described herein, the invoice engine would identify and retrieve the applicable entitlement for the activity, determine whether or not time, expense, and parts charges are billable, and further identify the applicable discounts (if any). In this case, the invoice generated for the activity would reflect a discount of $600 for parts, and the total invoice amount is $1700. The invoice may be generated to also show the $600 discount provided by the entitlement for the activity.

Figure 2:
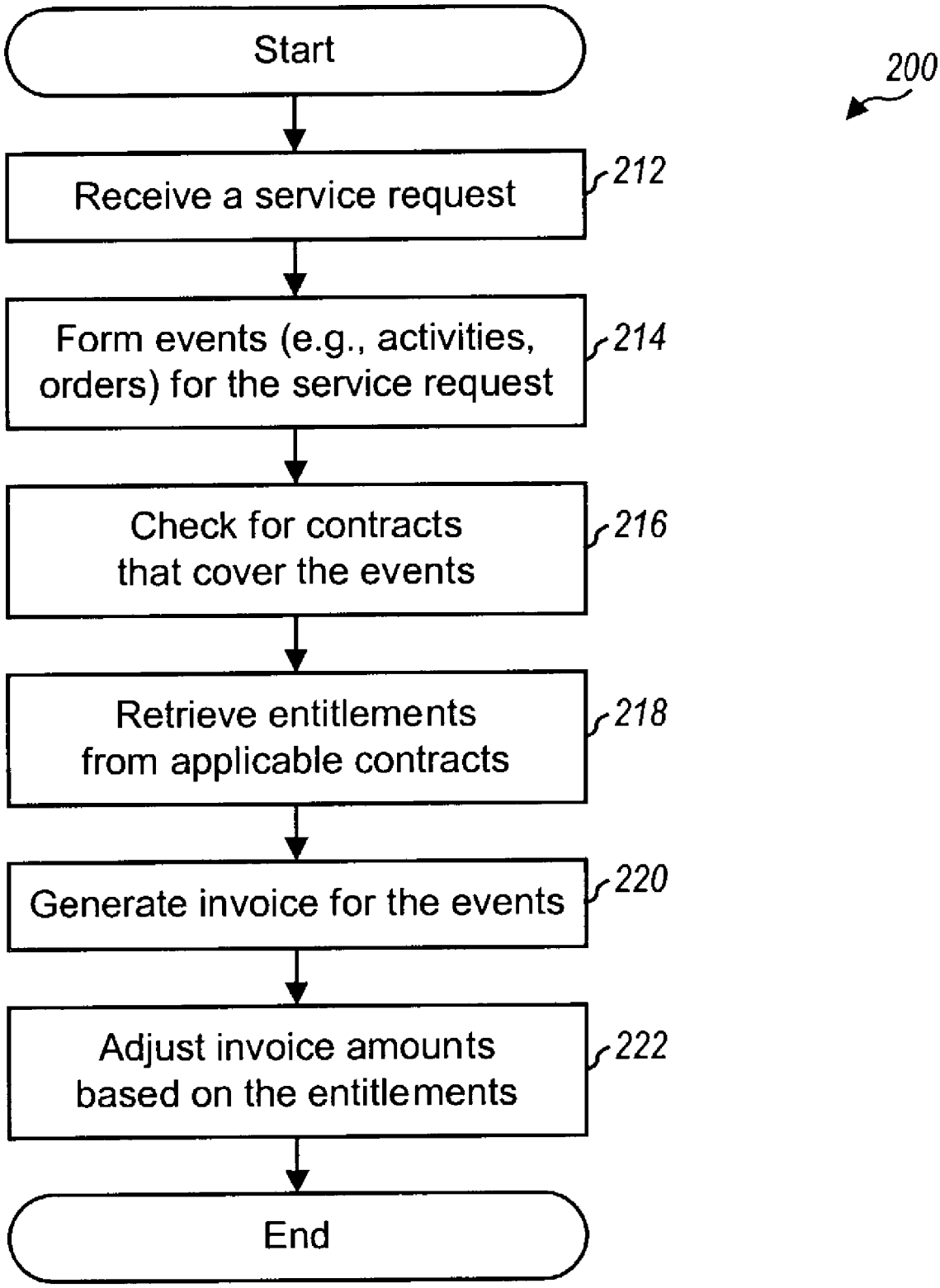
FIG. 2 is a flow diagram of an embodiment of an overall process to generate invoices with entitlements.

FIG. 2 is a flow diagram of an overall process 200 to generate invoices with entitlements, in accordance with an embodiment of the invention. Initially, a service request or some other communication is received (e.g., from a customer), at step 212. The service request may be for a set of one or more actions and/or transactions to be performed. One or more activities, orders, and so on (which are collectively referred to herein as "events") are then formed for the service request, at step 214. For example, the service request may call for the cleaning of a particular copier, the installation of a new print drum, the replacement of toner, and so on. An activity may then be formed for each of these actions. The service request may also be for the purchase of a new toner cartridge, the exchange of an automatic feeder tray, the lease of a new copier, and so on. An order may similarly be formed for each of these transactions.

As used herein, an event is any action or transaction that may be performed, and for which an invoice may be generated. Events comprise activities and orders that may be generated from service requests or some other communication. An event may also pertain to any product or asset. As used herein, a product may be any tangible or intangible item such as, for example, a good, a resource, a service, a class, training, and so on. An asset (e.g., Copier X) is a specific instance of a particular product (e.g., Copier).

The events are performed, and one or more invoices may be generated for the events. The invoice generation may be achieved by first checking for any contracts that cover the events, at step 216. For example, the service request may be related to a lease contract that provides for regular cleaning of a specific copier. The search for the applicable contracts may be based on account, contact, and/or product/asset information, as described below.

Entitlements from the applicable contracts are then retrieved, at step 218. As described in further detail below and in the aforementioned U.S. patent application Ser. No. 10/299,265, each contract may include entitlements, which are benefits to be received under the contract. The entitlements may cover certain products/assets and may provide for special pricing for certain type of events. For example, an entitlement may provide for free service and parts on new copiers for the first 90 days.

One or more invoices are then generated for the events, at step 220. The invoice amount for each event may be initially determined based on a standard pricing scheme for this type of event. For example, the invoice amount may be determined based on a particular Price List and/or Rate List. The invoice amounts for the events may then be adjusted based on the applicable entitlements, at step 222. This may entail determining a revised invoice amount for each event that is covered by entitlements, based on the entitlements. Discounts may also be determined for each event (if applicable), and may be used to show the amount of savings obtained through the entitlements.

The invoices may be generated periodically, as scheduled, when directed, and so on. Depending on the particular scheme used to generate invoices, steps 220 and 222 may be performed together for each event, step 220 may be performed for all events to be invoiced followed by step 222, or steps 220 and 222 may be performed in some other manner.

Figure 3:
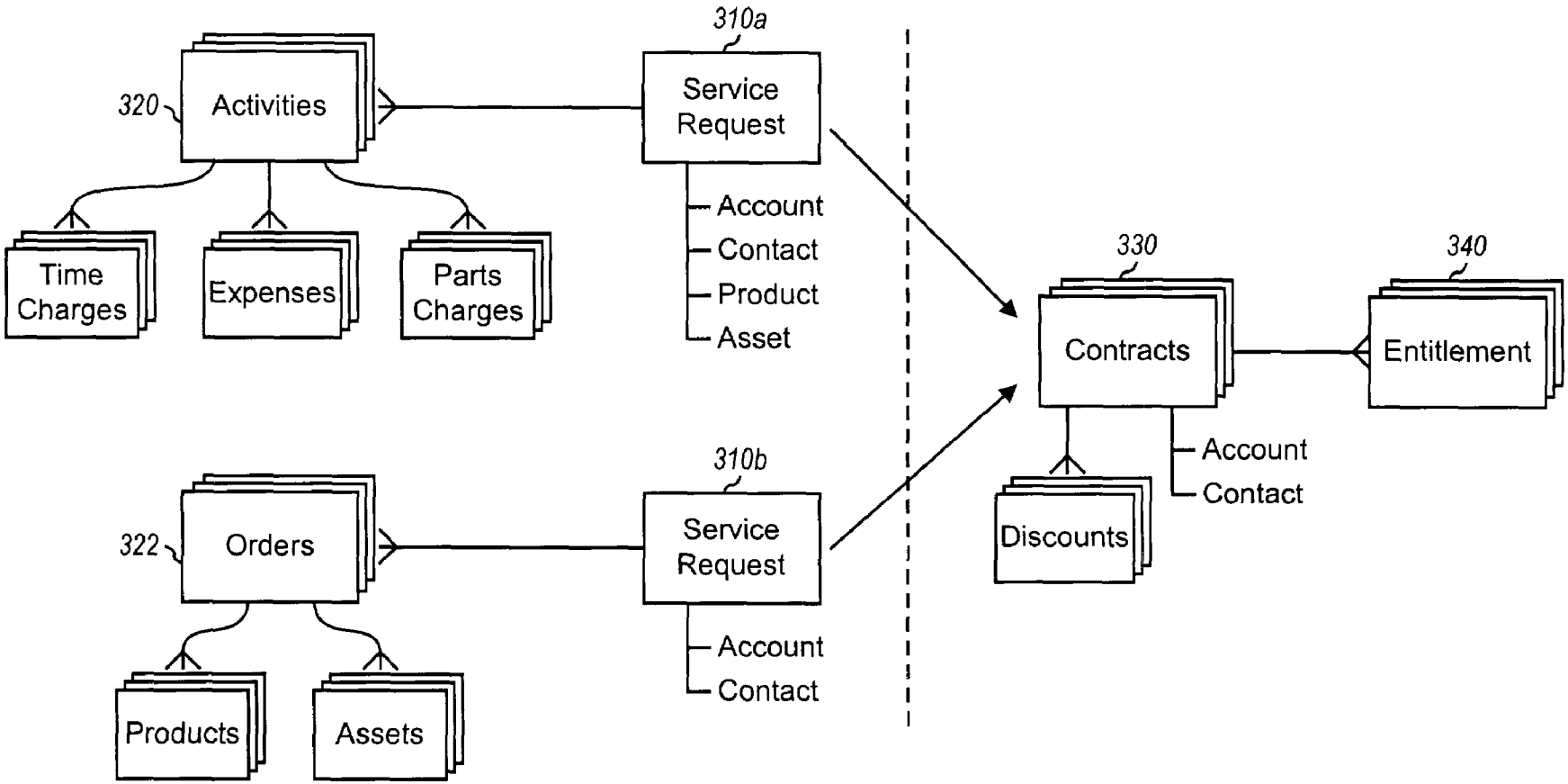
FIG. 3 is a diagram illustrating various components used to support entitlement-based invoice generation.

FIG. 3 is a diagram illustrating various components used to support entitlement-based invoice generation, in accordance with an embodiment of the invention. Initially, a service request 310 may be received (e.g., via a direct call, a call to a call center, a session on the web, or some other means). As used herein, a service request refers to any communication that may be received for one or more events, where each event may pertain to a particular action or transaction. Each service request may be associated with account, contact, and product/asset information, which may be provided when the service request is received. This information may be used to identify applicable contract(s) for the service request, as described below.

For a service request 310*a* related to a service, one or more activities 320 may be formed for the service request. Each activity may entail performing a particular service action (e.g., clean a copier, install a new print drum, replace toner, and so on). Each activity may further be related to one or more products and/or assets that may be the subject of the action. Each activity may also be associated with a product that covers the action (e.g., the product may be an extended warranty that covers the service request). Each activity may be associated with various charges (e.g., for time, expense, and parts) that may be incurred as a result of performing the associated action.

One or more orders 322 may also be formed for a service request 310*b*, with each order covering a particular transaction (e.g., a purchase of a new toner cartridge, a lease of a new copier, and so on). Each order may thus also be associated with one or more products and/or assets that may be the subject of the transaction.

One or more contracts 330 may have been formed and maintained by the contract management system. Each contract typically includes account and contract information used to identify the contract and for other purposes. For example, the account, contact, and product/asset information for the service request may be matched up against the same types of information for the contracts to identify contracts that are applicable for the service request. Each contract may also be associated with various entitlements 340 and/or discounts, both of which may be applied to the events covered by the contract. The entitlements and discounts (which are described in further detail below) from the applicable contracts are used in generating the invoices for the activities and orders.

Figure 4:
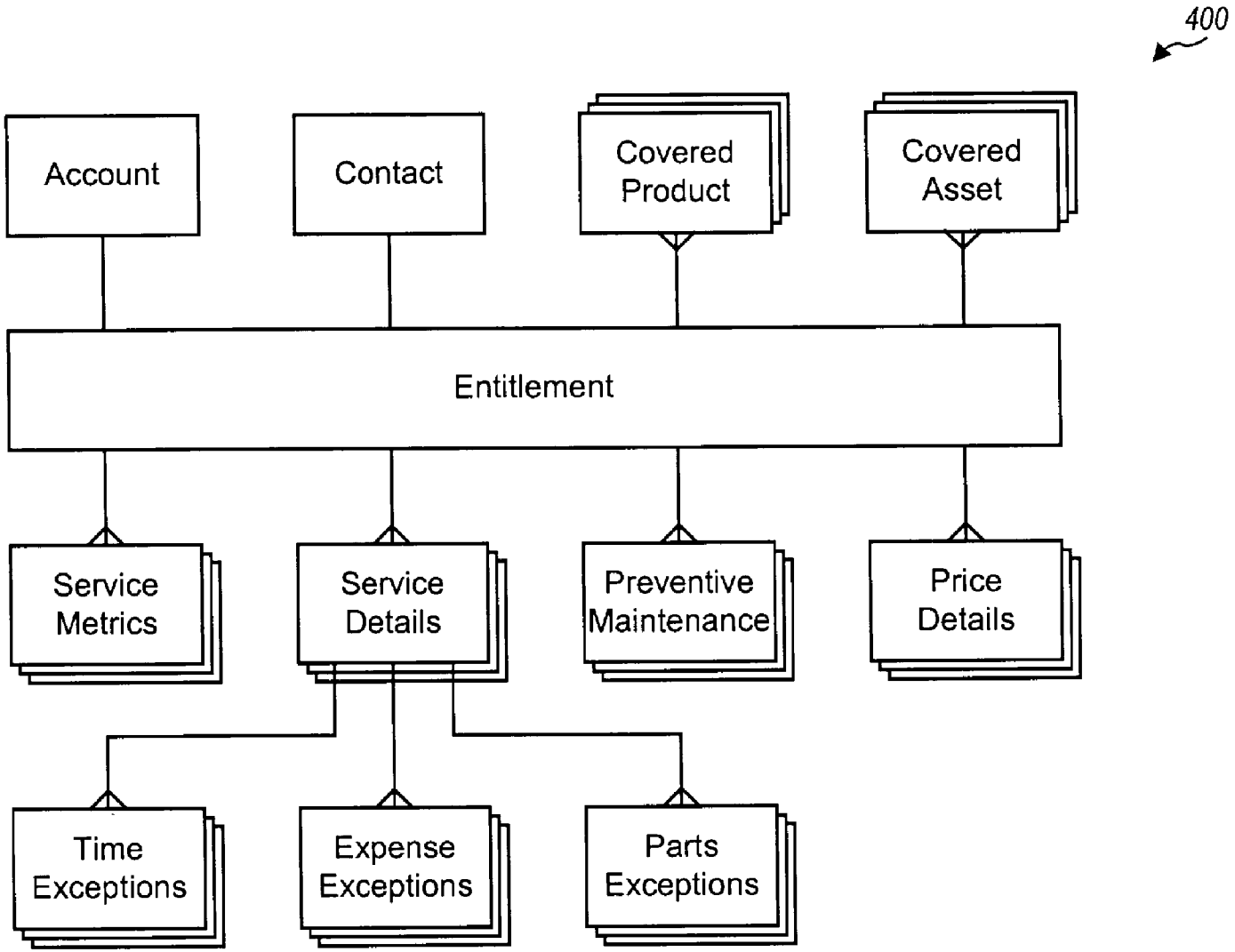
FIG. 4 is a diagram of an embodiment of a data model for an entitlement.

FIG. 4 is a diagram of a data model 400 for an entitlement, in accordance with a specific embodiment of the invention. An entitlement may be associated with account and contact information that may be entered specifically for the entitlement, or may be copied from the contract that incorporates the entitlement.

An entitlement may be defined to include one or more components used to define the scope of the benefits. Table 1 lists some of the entitlement components that may be included in an entitlement. Fewer, additional, and/or different entitlement components may also be made available for inclusion in entitlements, and this is within the scope of the invention.

TABLE 1

| Entitlement Components | Description |
|---|---|
| Products/Assets | the products/assets that may be selected for coverage under the entitlement |
| Service Metrics | the metrics used to define the level of service to be provided under the entitlement |
| Preventive Maintenance | the preventive maintenance plans covered by the entitlement |
| Service Details | the service activities covered by the entitlement; exceptions may be defined for each type of service:<br>Time Exception - specify parameters for determining charges for time spent in connection with an activity<br>Expense Exception - specify parameters for determining charges for expenses incurred connection with an activity<br>Parts Exception - specify parameters for determining charges for parts required for an activity |
| Pricing Details | specify special pricing under the entitlement for a set of defined products and/or resources |

An entitlement may be defined to cover one or more products and/or assets, which may be selected from a list of defined products/assets. The products/assets covered by the entitlement are entitled to receive the benefits specified by the entitlement.

An entitlement may be defined to cover one or more types of service activity (e.g., "Phone Support", "Field Repair", "Technical Support", "Preventive Maintenance", "Service", and so on), as specified in the Service Details component. Each such service activity type may be associated with a respective set of parameter values used to determine the amount to be invoiced for that activity type. For example, the service details for each covered activity type may specify whether various activity items (e.g., time, expenses, and parts) are billable, the percentage discount for each activity item, the maximum discount that may be applied for each activity item, the maximum that may be billed for each activity item, and so on.

Each service activity type may also be associated with Time Exceptions, Expense Exceptions, and Parts Exceptions, which may be used to further define the scope of coverage. For example, each type of Exceptions may specify what is covered by the entitlement, the amount of coverage, and so on. This additional information is also used to determine the invoice amount for an activity. The Service Details component and the Exceptions are described in further detail below.

An entitlement may be defined to cover one or more preventive maintenance plans for a set of identified products and/or assets, as specified in the Preventive Maintenance component. As used herein, preventive maintenance includes any proactive action that may be defined (e.g., by an administrator or an end-user) and which may be initiated based one or more defined trigger events. As examples, proactive actions may include automatically sending a customer an email or letter informing him/her of recommended services and/or replacements, upgrades, or inspections for part based on actual asset usage and/or actual product performance indicators, monitors, measurements, readings, and/or telemetrics.

An entitlement may be defined to provide special pricing for a set of defined products, assets, and/or resources, as specified in the Price Details component. The price details may be specified for each covered product, and may include various information such as, for example, (1) a price basis (e.g., a Cost, List, or Promotional price) for the product from which adjustments, if any, are made, (2) a method for computing adjustments to the price basis (e.g., a discount amount, discount percentage, mark-up amount, mark-up percentage, or fixed price), and (3) the amount of adjustment to be applied to the price basis (e.g., in percent or dollar amount). The Price Details component is described in further detail below.

The components of the entitlement include various types of information used to determine the invoice amount and discounts for an event. In FIG. 4, the symbol "⅄" denotes a possible one-to-many relationship between the entitlement and the entitlement components. The entitlement components listed in Table 1 are described in further detail in the aforementioned U.S. patent application Ser. No. 09/967,895.

Figure 5:
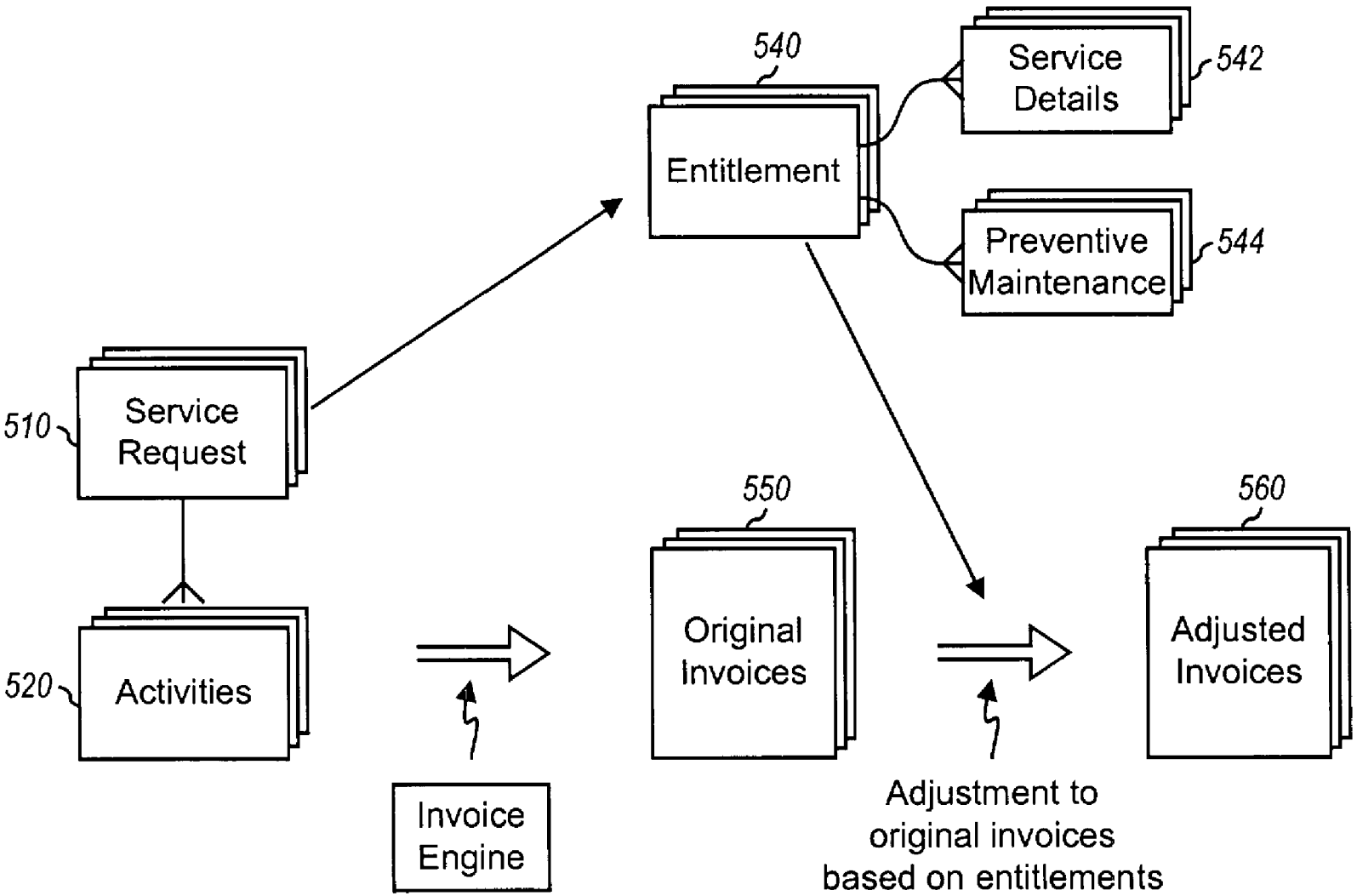
FIG. 5 is a diagram that graphically illustrates an embodiment of the generation of invoices with entitlements.

FIG. 5 is a diagram that graphically illustrates an embodiment of the generation of invoices with entitlements. In the example shown in FIG. 5, a number of activities 520 may be formed for a number of service requests 510 (orders are not shown in FIG. 5 for simplicity). To generate invoices for the activities, entitlements 540 applicable to the activities are retrieved from applicable contracts, and the pertinent entitlement components (e.g., Service Details 542 and Preventive Maintenance 544) for the activities are identified. Invoices 550 may then be generated for activities 520 (e.g., based on standard Price and Rate Lists) by the invoice engine (e.g., invoice engine 115 in FIG. 1). Thereafter, original invoices 550 may be adjusted based on the applicable entitlements 540 to generate adjusted invoices 560. Any special contract pricing terms that apply to the activities are considered, and the proper discounts are calculated and applied to the original invoice amounts to obtain the adjusted invoice amounts. Adjusted invoices 560 may then be provided to the appropriate module (e.g., contract manager 114). Two sets of invoices 550 and 560 are shown in FIG. 5 for clarity. Typically, only one set of invoices is actually generated for the activities.

In an alternative embodiment, the adjusted invoice amounts may be determined for the activities based on the details of applicable entitlements (without determining the original invoice amounts for the activities). For example, if an activity is covered by a preventive maintenance plan, than no charge is invoiced for the activity and there may be no need to determine the original invoice amount. However, this original invoice amount may be determined anyway, e.g., to show the amount of savings obtained through the entitlements.

Figure 6:
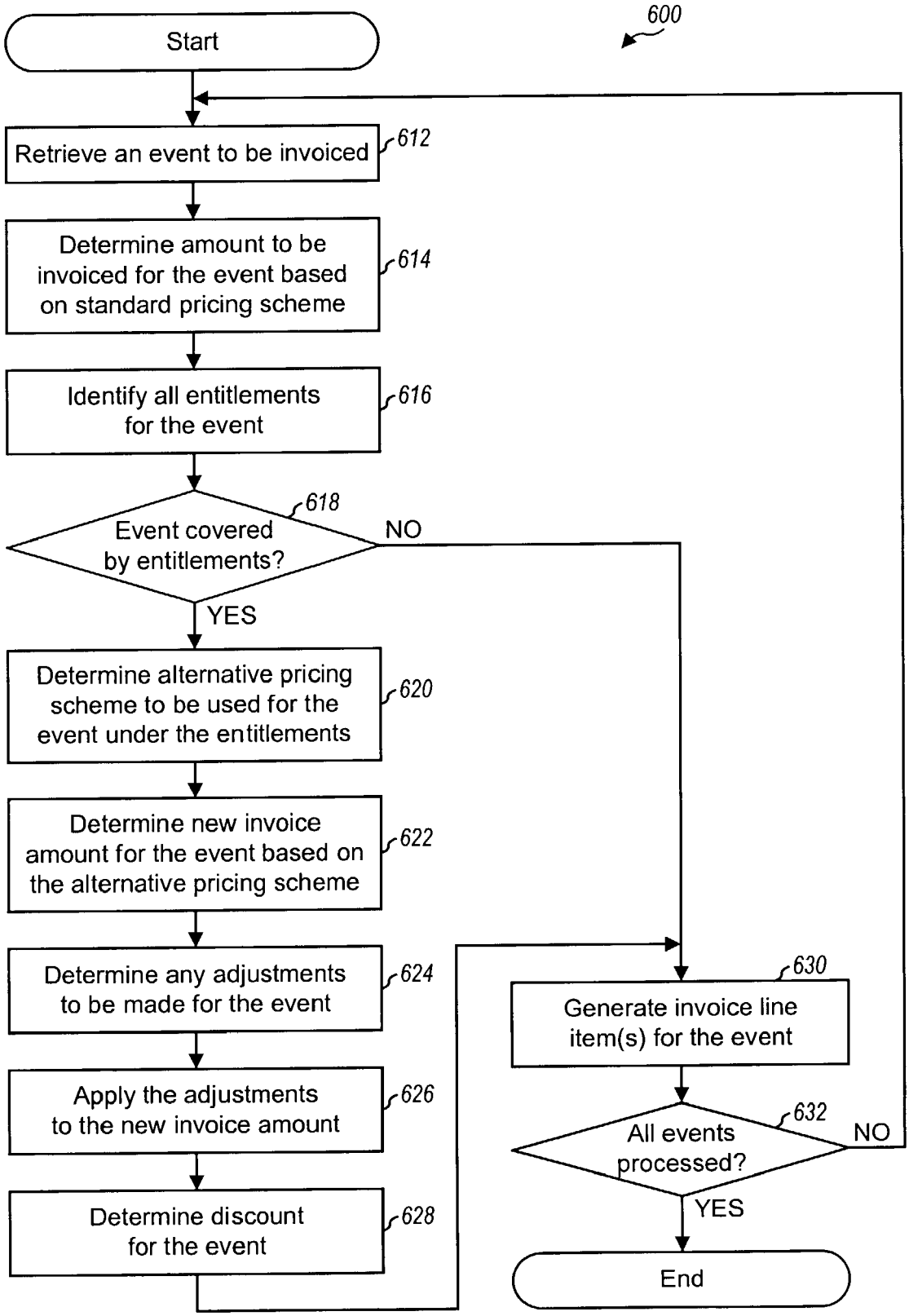
FIG. 6 is a flow diagram of a specific embodiment of a process to generate invoices with entitlements.

FIG. 6 is a flow diagram of a specific embodiment of a process 600 to generate invoices with entitlements. Process 600 may be performed to generate any number of invoices for any number of events (e.g., activities, orders, and so on). The events may be formed from one or more service requests or some other communication, and may be covered by one or more applicable contracts. Typically, one invoice is generated for each account, which may be designated in the service request, the contract, or the event.

Initially, an event to be invoiced and its pertinent invoicing information are retrieved, at step 612. This information may include, for example, the event type, rate type, expense type, elapsed time, expense records, parts records, billable indicator flags, and so on. The amount to be invoiced for the event is then determined in the normal manner based on a standard pricing scheme, at step 614. For example, the invoice amount for the event may be determined based on a Price List and/or a Rate List applicable to this type of event. The invoice amount may include a number of charges for a number of items for the event (e.g., charges for time, expense, and parts). These "original" invoice amounts may be used later as the price basis for calculating discounts under entitlements.

All entitlements for the event are then identified, at step 616. This may be achieved, for example, by matching the account and contact information for the event with that of the contracts. The event may be associated with zero, one, or multiple entitlements.

A determination is then made whether or not the event is actually covered by the identified entitlements, at step 618. This "entitlement verification" may include checking whether the event's type is covered by the entitlements, whether the products/assets associated with the event are covered by the entitlements, and so on. Entitlement verification may be achieved in various manners, as described in further detail below. If the event is not covered by any entitlement, then the process proceeds to step 630.

Otherwise, if the event is covered by one or more entitlements, then the alternative pricing scheme(s) to be used for the event under the entitlements is determined, at step 620. Various pricing schemes may be supported for entitlements. For example, the pricing schemes may specify the use of discount Price and/or Rate Lists, flat or fixed-rate pricing, time and materials pricing, time, expense, and parts pricing, or some other manner of determining the invoice amount. A new (or revised) invoice amount for the event is then determined based on the alternative pricing scheme, at step 622.

Additional adjustments to be made to the invoice amount for the event are then determined, at step 624. These adjustments may be derived from the applicable entitlements and/or contact. If there are any such adjustments, then the adjustments are applied to the new invoice amount, at step 626. The discounts for the event with the entitlements may also be determined, at step 628, and may be used to show the savings obtained through the entitlements.

One or more invoice line items are then generated for the event, at step 630. As noted above, one invoice is typically generated for each account. If an invoice for the event's account has not been created, then a new invoice is created for this account with the proper invoice header. Otherwise, the invoice already created for the event's account is retrieved. The invoice for the event may be generated in various manners. In one embodiment, one invoice line item with both the invoice amount and the discount amount is generated for the event. In another embodiment, one invoice line item with the invoice amount and another invoice line item with the discount amount are generated for the event.

At step 632, a determination is made whether or not all events have been processed. If the answer is no, then the process returns to step 612 and another event is retrieved for invoicing. Otherwise, if all events have been invoiced, then the process terminates.

FIG. 6 shows a specific embodiment of the processing to generate invoices for events and taking into consideration applicable entitlements. Many other invoice generation schemes may also be implemented, and this is within the scope of the invention. Several invoice generation schemes for activities and orders are described below for illustration.

Figure 7A:
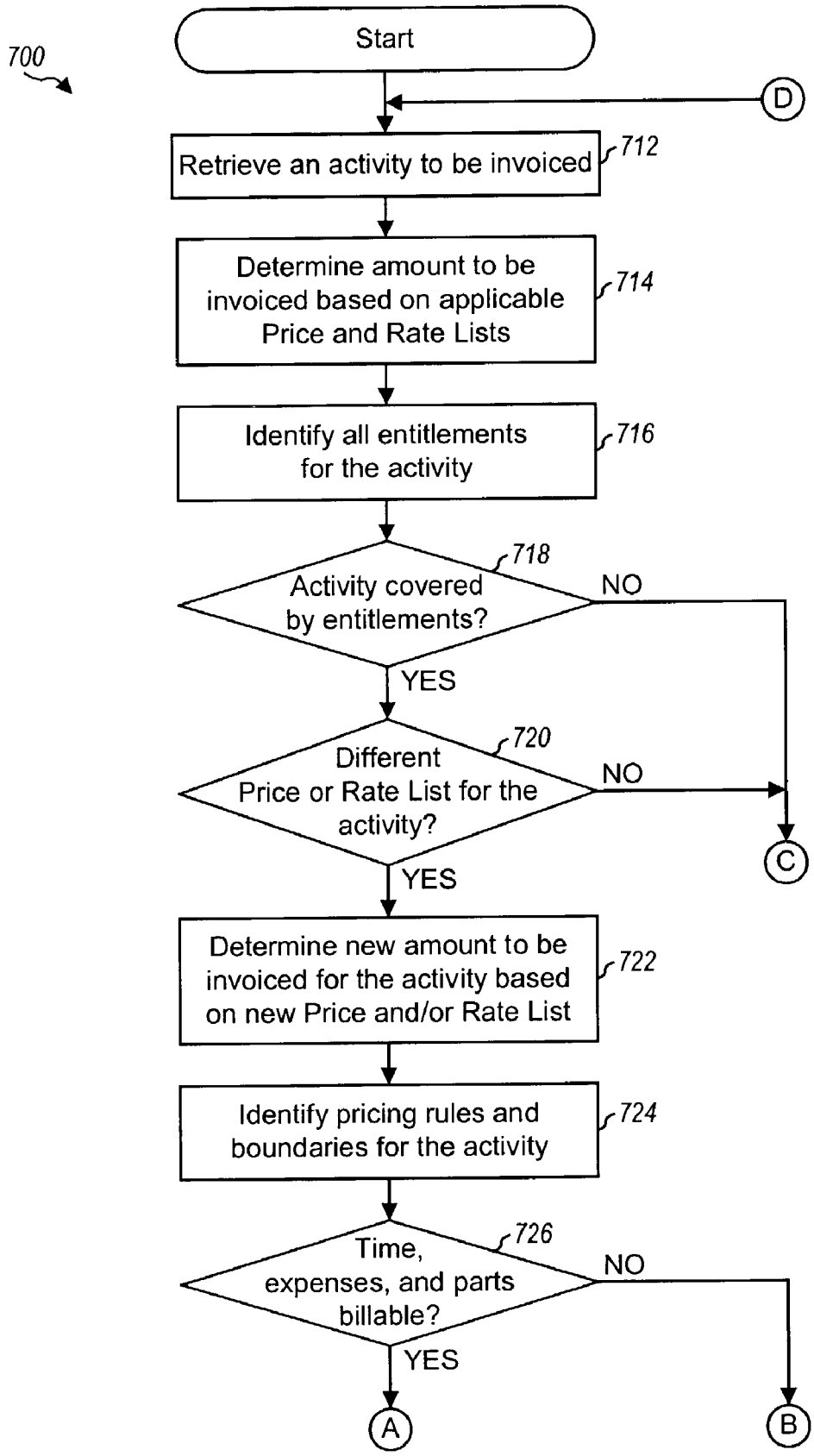
FIGS. 7 and 8 are flow diagrams of two specific embodiments of a process to generate invoices for activities and taking into consideration entitlements.
Figure 7B:
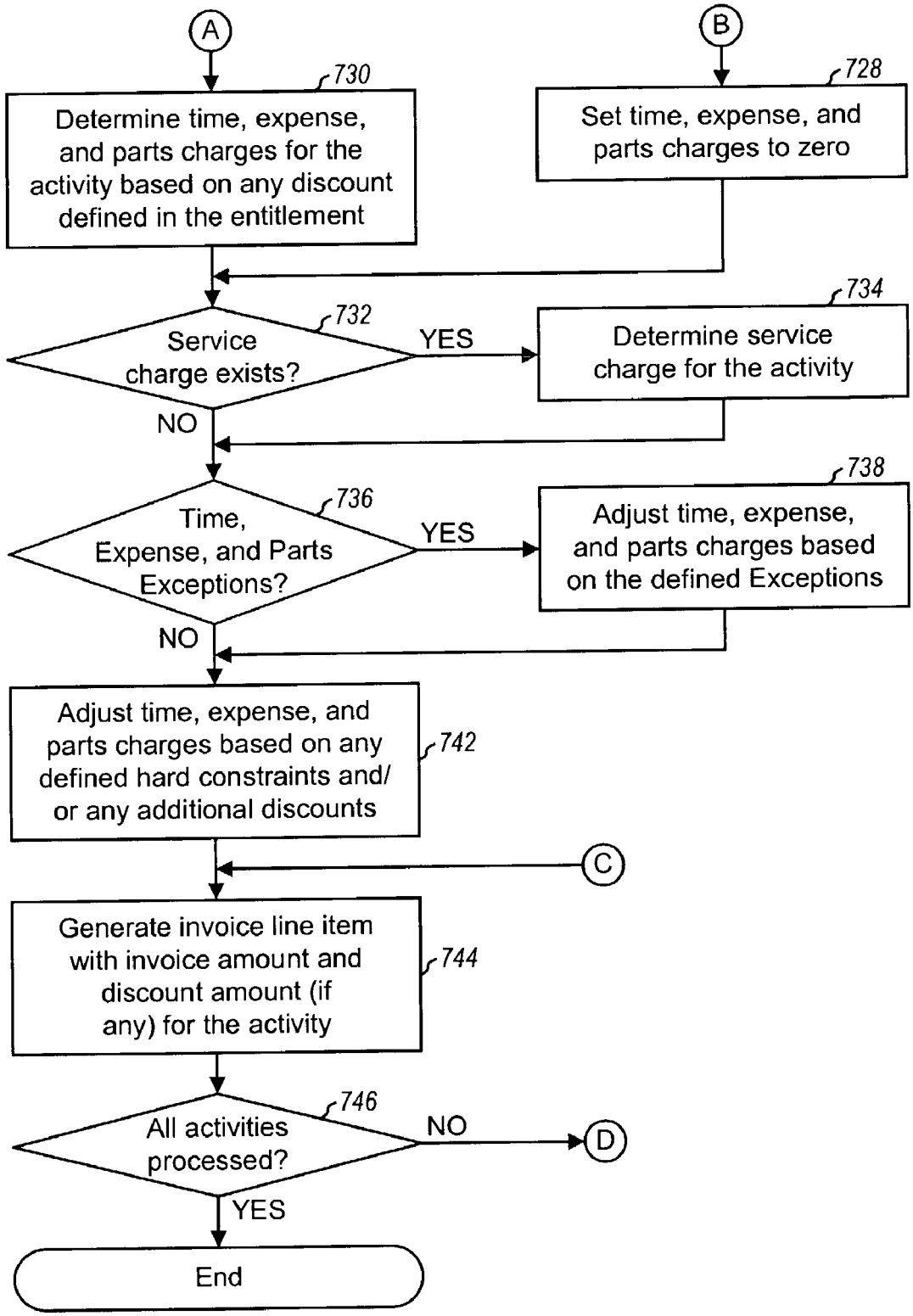

FIG. 7 is a flow diagram of a specific embodiment of a process 700 to generate invoices for activities and taking into consideration entitlements. Process 700 may be performed to generate any number of invoices for any number of activities. For this embodiment, each activity may be associated with charges for time, expenses, and parts.

Initially, an activity to be invoiced and its pertinent information are retrieved, at step 712. The (original) amount to be invoiced for the activity is then determined in the normal manner (e.g., based on standard Price and/or Rate Lists applicable to this type of activity), at step 714. All entitlements for the activity are then identified (e.g., based on account and contact information), at step 716. A determination is then made whether the activity is actually covered under the identified entitlements (e.g., based on product and/or asset information), at step 718. If the activity is not covered by any entitlement, then the process proceeds to step 744.

Otherwise, if the activity is covered by one or more entitlements, then a determination is made whether or not different Price and/or Rate Lists are to be used for the activity under the entitlements, at step 720. If the answer is no, then the process also proceeds to step 744. Otherwise, a new (revised) amount to be invoiced for the activity is determined based on the new Price and/or Rate List, at step 722. The original invoice amount determined in step 714 or the revised invoice amount determined in step 722 (e.g., if the original invoice amount is not determined in step 714) may be used as the price basis for determining discounts.

At step 724, pricing rules and boundaries (if any) for the activity are identified. These rules and boundaries may be derived from the applicable entitlements and/or contract. A determination is then made whether or not time, expense, and parts charges are billable for the activity, at step 726. This may be achieved by checking three Billable flags maintained for the three activity items. In an embodiment, if the Billable flag is not set for a given activity item, then that item is not specifically billable, unless an exception is defined for that item. For each activity item that is not billable, the charge for that activity item is set to zero, at step 728. And for each activity item that is billable, the charge and any discounts defined for the activity item are determined, at step 730.

A determination is also made whether or not a service charge exists for the activity, at step 732. If the answer is yes, then the service charge for the activity is determined, at step 734, and included in the invoice for the activity. Otherwise, step 734 is skipped.

A determination is then made whether or not there is any additional pricing information in the Time, Expense, and Parts Exceptions that may be applicable to the activity, at step 736. If the answer is yes, then the time, expense, and/or parts charges may be adjusted or overridden, and/or the billing status may be changed based on the additional pricing information, at step 738. Otherwise step 738 is skipped.

At step 742, the time, expense, and parts charges may be further adjusted based on any defined hard constraints and/or additional discounts. For example, a maximum discount for the activity may be defined, in which case the total discount amount for time, expense, and parts cannot exceed this amount. A maximum billable amount for the activity may alternatively or additionally be defined, in which case the total charges for time, expense, and parts cannot exceed this maximum amount.

One or more invoice line items are then generated for the activity, at step 744. An invoice line item may be generated for each activity or each activity item, and may include the invoice amount and the discount amount (if any).

A determination is then made whether or not all activities have been processed, at step 746. If the answer is no, then the process returns to step 712 and another activity is retrieved for invoicing. Otherwise, if all activities have been invoiced, then the process terminates.

Figure 8A:
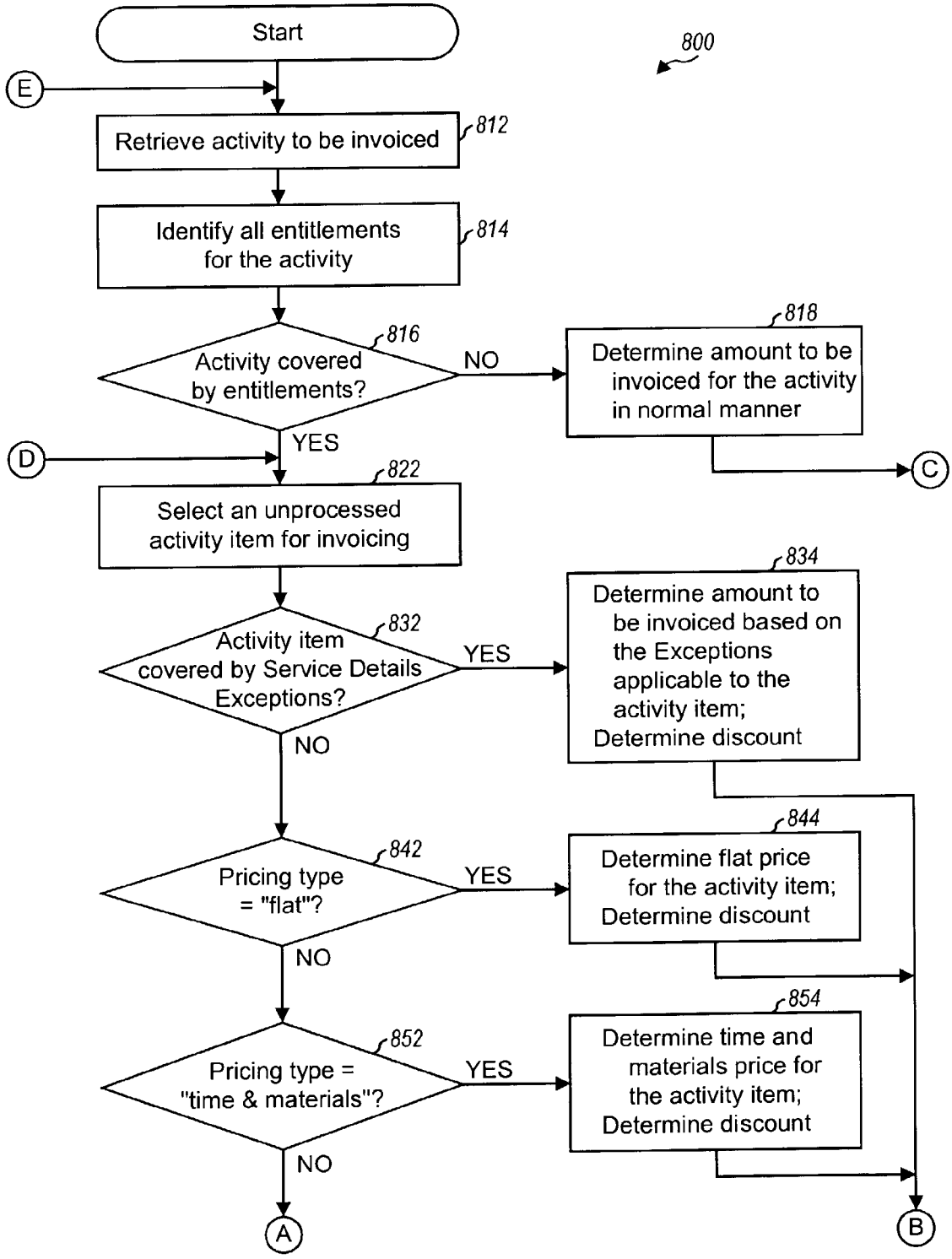
Figure 8B:
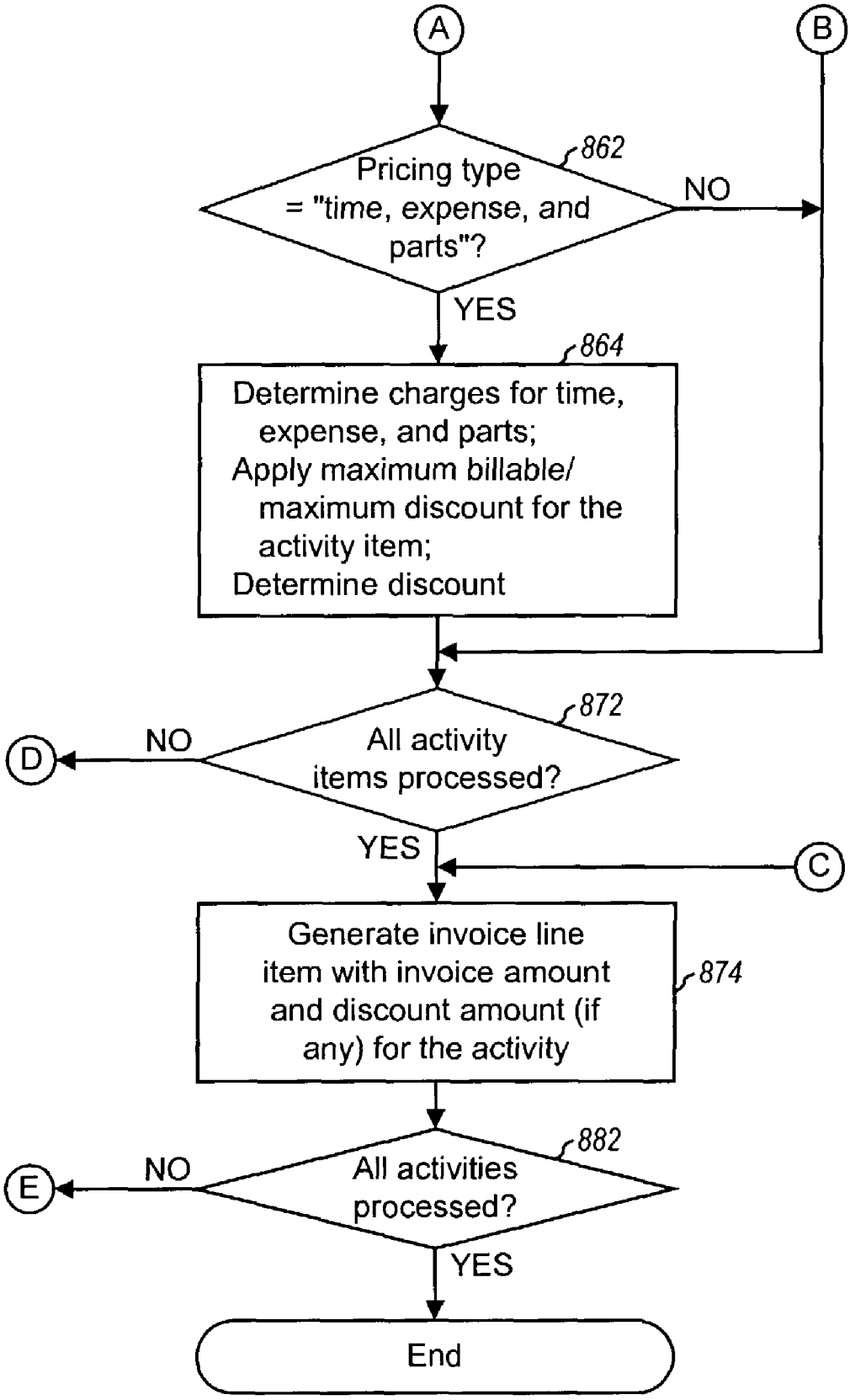

FIG. 8 is a flow diagram of another specific embodiment of a process 800 to generate invoices for activities and taking into account entitlements. Process 800 may also be performed to generate any number of invoices for any number of activities.

Initially, an activity to be invoiced and its pertinent information are retrieved, at step 812. All entitlements for the activity are then identified (e.g., by matching the account and contact information for the activity with that of the contracts), at step 814. A determination is then made whether or not the activity is actually covered under the applicable entitlements (e.g., based on product and/or asset information), at step 816. If the activity is not covered by any entitlement, then the amount to be invoiced for the activity may be determined in the normal manner (e.g., based on standard Price and/or Rate Lists applicable to that type of activity), at step 818. The process then proceeds to step 874.

Otherwise, if the activity is covered by one or more entitlements, then each item of the activity is invoiced by taking into account the applicable entitlements. An activity may include one or more items, depending on the context in which the activity is formed. In an embodiment, activity items are categorized into three areas—time, expense, and parts, and activities may be categorized into any number of types. In an embodiment, for a given activity, activity items that are billable are billed based on the pricing defined under the applicable entitlements and by the activity's type. Thus, an activity of type A may include activity items billed at different rates than an activity of type B having similar activity items. As an example, an activity generated for a service request may include three items for time charges, expenses, and parts charges, each of which may be associated with its own special pricing. In an embodiment, each activity item may be billed as a separate invoice line item. In the embodiment shown in FIG. 8, the items for the activity are processed one at a time, by selecting an unprocessed activity item for invoicing, at step 822.

The invoice amount for the activity item may be determined based on various pricing schemes. The specific pricing schemes to be used may be dependent on how the entitlements are defined. FIG. 8 illustrates some specific pricing schemes that may be used in conjunction with the entitlement defined in FIG. 4.

At step 832, a determination is made whether or not the activity item is included in the Service Details (Time, Expense, and Parts) Exceptions for the identified entitlements. If the answer is yes, then the amount to be invoiced is determined based on the Exceptions applicable to the activity item, and the discount for the activity item is also determined, at step 834. Otherwise, if this pricing scheme does not apply to the activity item, then the process proceeds to step 842.

At step 842, a determination is made whether or not flat or fixed-rate pricing is to be applied to the activity item. If the answer is yes, then the flat price to be invoiced for the activity item as well as the discount are determined, at step 844. Otherwise, if this pricing scheme does not apply to the activity item, then the process proceeds to step 852.

At step 852, a determination is made whether or not "time and materials" pricing is to be applied to the activity item. If the answer is yes, then the time and materials price to be invoiced for the activity item as well as the discount are determined, at step 854. Otherwise, if this pricing scheme does not apply to the activity item, then the process proceeds to step 862.

At step 862, a determination is made whether or not "time, expense, and parts" pricing is to be applied to the activity item. If the answer is yes, then the time, expense, and parts charges to be invoiced for the activity item as well as the discount are determined, at step 864. The charges may be determined based on the applicable Price and/or Rate Lists. The maximum billable amount and/or maximum discount specified by the applicable entitlements (if any) are also applied to the determined charges, at step 864. The process then proceeds to step 872.

At step 872, a determination is made whether or not all items for the activity have been processed. If the answer is no, then the process returns to step 822 and another unprocessed activity item is selected for invoicing. Otherwise, if all activity items have been processed, then one or more line items may be generated in the invoice for the activity, at step 874. For example, one invoice line item may be provided for the activity or for each activity item.

At step 882, a determination is made whether or not all activities have been processed. If the answer is no, then the process returns to step 812 and another activity is retrieved for invoicing. Otherwise, if all activities have been invoiced, then the process terminates.

Steps 832, 842, 852, and 862 represent four different pricing schemes that may be used for invoicing. Some of these pricing schemes are described in further detail in the aforementioned U.S. patent application Ser. No. 09/967,862. Other pricing schemes may also be implemented, and this is within the scope of the invention.

Figure 9:
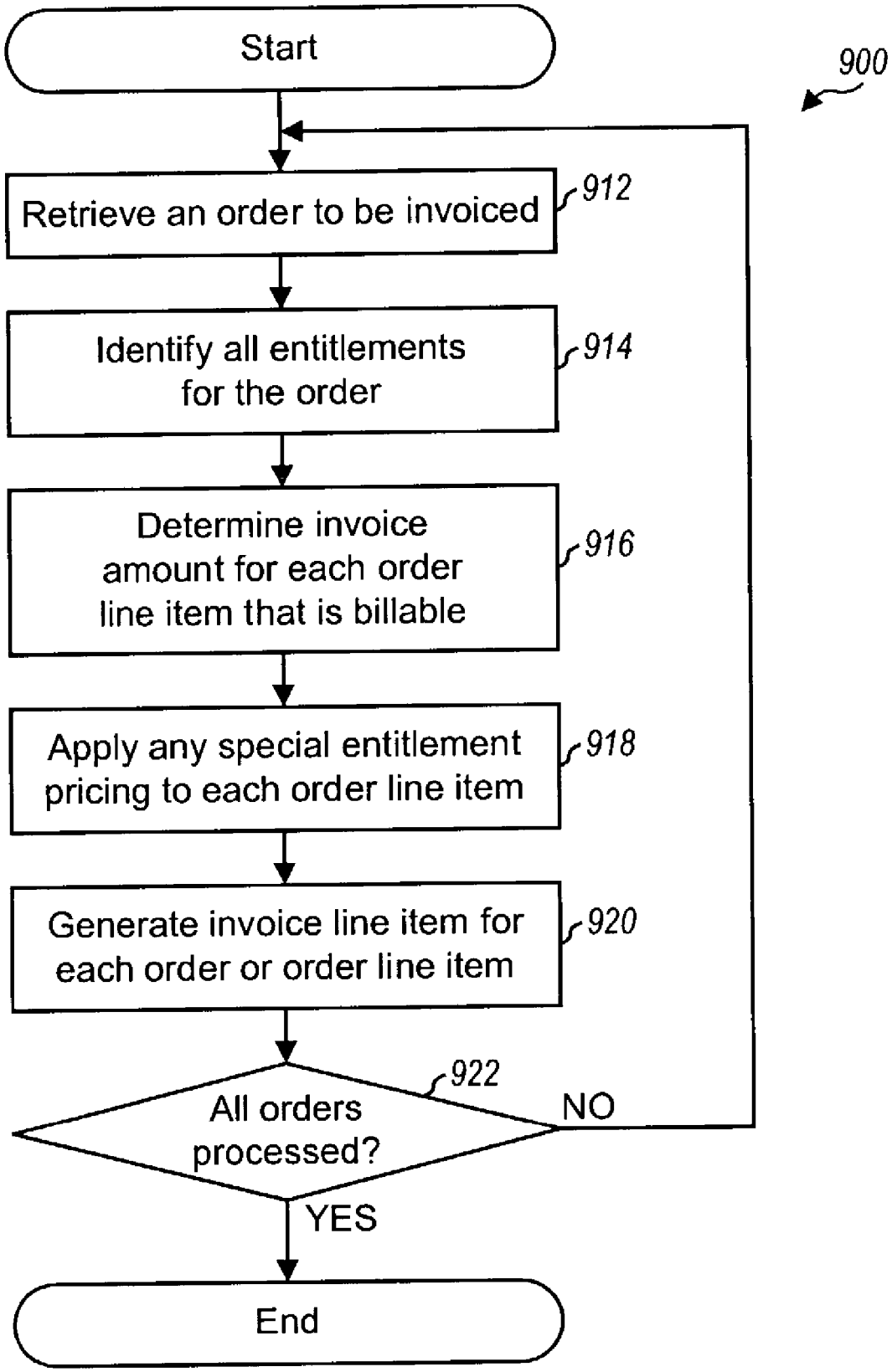
FIG. 9 is a flow diagram of a specific embodiment of a process to generate invoices for orders and taking into consideration entitlements.

FIG. 9 is a flow diagram of a specific embodiment of a process 900 to generate invoices for orders and taking into consideration entitlements. Process 900 may be performed to generate any number of invoices for any number of orders.

Initially, an order to be invoiced and its pertinent information are retrieved, at step 912. Each order may be associated with one or more line items, and each line item may cover one or more products and/or assets. All entitlements applicable for the order are then identified (e.g., based on the account, contract, and/or product/asset information for the order and the contracts), at step 914. The invoice amount for each order line item that is billable is then determined, at step 916.

In an embodiment, the invoice amount for the billable order line item is a price that is retrieved from the applicable entitlement and/or contract. This price for the order line item may be the proper price to be applied, and includes any special entitlement-based pricing. In this case, no additional adjustment to the invoice amount for the order line item price may be necessary. In another embodiment, special pricing may be define for the order line item (e.g., in the Price Details components of the applicable entitlements). For this embodiment, any special entitlement pricing applicable to the order line item is retrieved and applied, at step 918.

An invoice line item is then generated for each order or for each order line item, at step 920. A determination is then made whether or not all orders have been processed, at step 922. If the answer is no, then the process returns to step 912 and another order is retrieved for invoicing. Otherwise, if all orders have been invoiced, then the process terminates.

The identification of contracts that cover an event (e.g., an activity or order) may be made based on the account and contact information for the event (or the service request) and the account and contact information for the contracts.

The determination of whether or not an event is actually covered by an entitlement (e.g., in step 816 in FIG. 8) may be made based on the product/asset information for the event and the entitlement. Moreover, this determination may be made based on certain defined logic. For clarity, Table 2 shows a specific example logic for entitlement verification. In this example, Asset A1 is an instance of Product A, and "All Products" includes a set of defined Products that includes product A. The first column in Table 2 lists the possible coverage that may be defined for the entitlement. The second column lists the products/assets covered by the entitlement for the coverage shown in the first column. And the third column lists the products/assets not covered by the entitlement for the coverage shown in the first column. For example, in the third row of Table 2, if the entitlement is defined to cover Asset A1, then the event is covered by the entitlement if it is for Asset A1, and is not covered by the entitlement if it is for Product A (even though Asset A1 is an instance of Product A), any other Asset, no Product, or no Asset.

TABLE 2

| Entitlement Coverage | Covered Products/Assets | Not Covered Products/Assets |
|---|---|---|
| All Products | Product A, any Product, any Asset of any Product, no Product, or no Asset | |
| Product A | Product A, Asset A1 , or Asset X (an instance of Product A) | Product B, no Product, or no Asset |
| Asset A1 | Asset A1 | Product A (even though A1 is an instance of Product A), any other Asset, no Product, or no Asset |
| Assets | any Asset | Product A, any Product, no Product, or no Asset |

Other logic may also be defined for entitlement verification, and this is within the scope of the invention.

The techniques of the invention may be implemented in various manners and using various user interfaces (e.g., screens). For clarity, a specific implementation of various aspects and embodiments of the invention is described below.

Figure 10A:
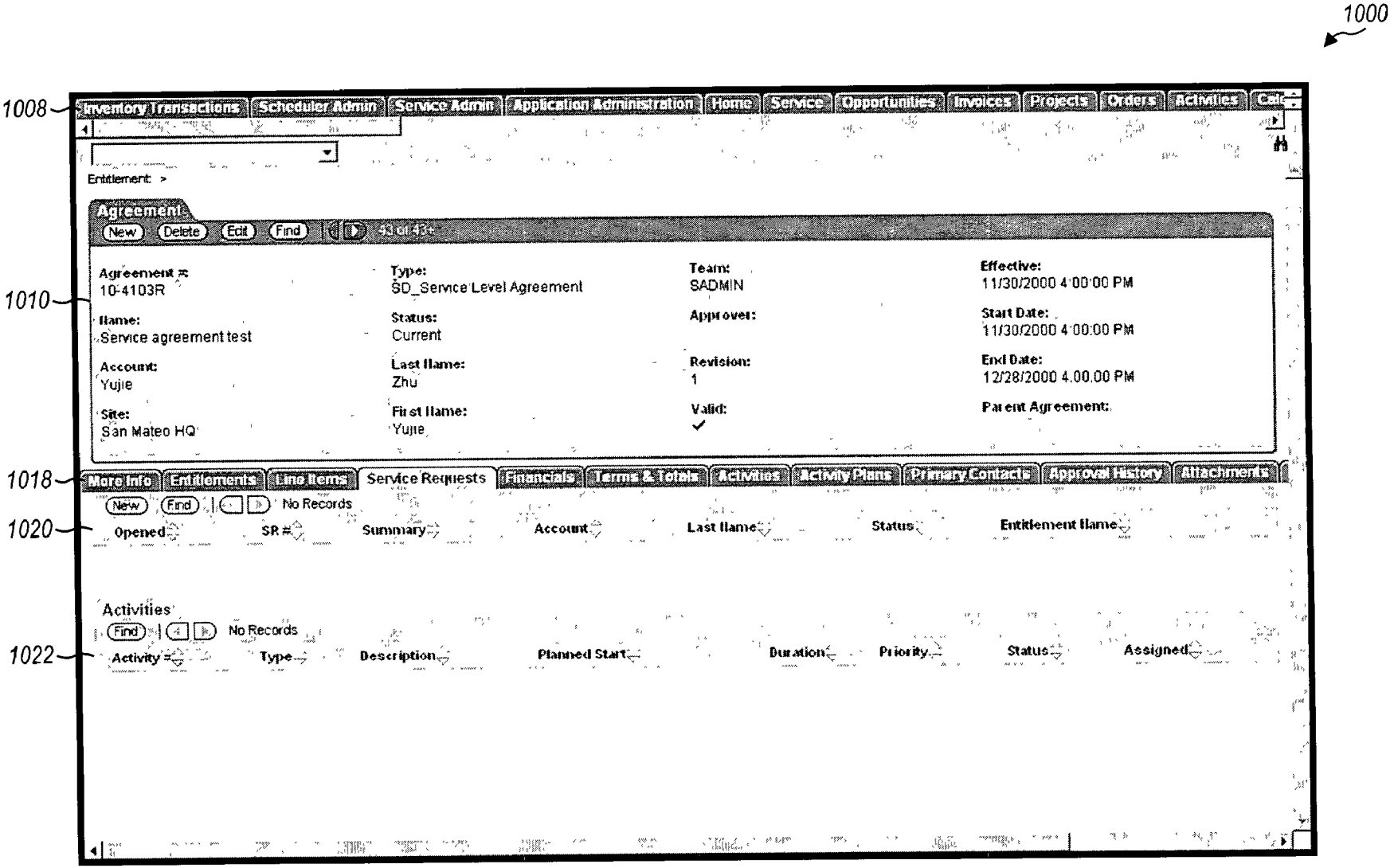
FIGS. 10A through 10G show various screens that may be used to view and edit information used to support entitlement-based invoice generation.

FIG. 10A shows a screen 1000 that may be used (e.g., by an administrator or an end-user) to view and edit a specific agreement (i.e., an executed contract), in accordance with a specific embodiment of the invention. Screen 1000 includes main menu tabs 1008 that may be used to invoke various modules, functionality, and features provided by an overall system. In such a design, the contract management system may represent just one of many individual systems included in the overall system.

Screen 1000 includes an Agreements form applet 1010 that is used to display information for a specific agreement, which may be selected from among a set of agreements. In FIG. 10A, Agreement form applet 1010 shows general information for the selected agreement.

Screen 1000 also includes menu tabs 1018 that may be invoked to obtain various "views" of the selected agreement, with each view providing different information for the selected agreement. In FIG. 10A, the "Service Requests" tab is selected. In response, a Service Requests list applet 1020 and an Activities list applet 1022 are provided to display all service requests and all related activities, respectively, which are associated with the agreement and may have been covered under the entitlements in the agreement. List applets 1020 and 1022 may be used to quickly view/communicate service issues for a given agreement. No service requests and no activities are shown in FIG. 10A for the example list applets 1020 and 1022.

Service Requests list applet 1020 displays service requests associated with the agreement via a list table, with each data row in the table corresponding to a record for one service request. The list table further includes a number of columns for a number of fields of each service request. Such fields may include, for example, Account, Site, First Name, Last Name, Product, Asset, Billable, Price List, Rate List, and so on. In an embodiment, the values for these fields of the service request are inherited by any new activity created under the service request. In an embodiment, the values for the Account, Site, First Name, Last Name, Entitlement, Billable, Price List, and Rate List fields of the service request are inherited by any new order created under the service request. An order (or an activity) may also be associated with an entitlement directly without a service request, and may further be associated with an entitlement that is different from that of the service request.

Activities list applet 1022 displays activities related to the agreement via a list table, with each data row in the table corresponding to a record for one activity. The list table further includes a number of columns for a number of fields of each activity. Such fields may include, for example, Activity #, Activity Type, Description, Planned Start, Duration, Priority, Status, Assigned, and so on.

A screen may also be provided to show all service requests related to a given entitlement. For each such service request, all activities and/or orders for the service request may also be displayed.

Figure 10B:
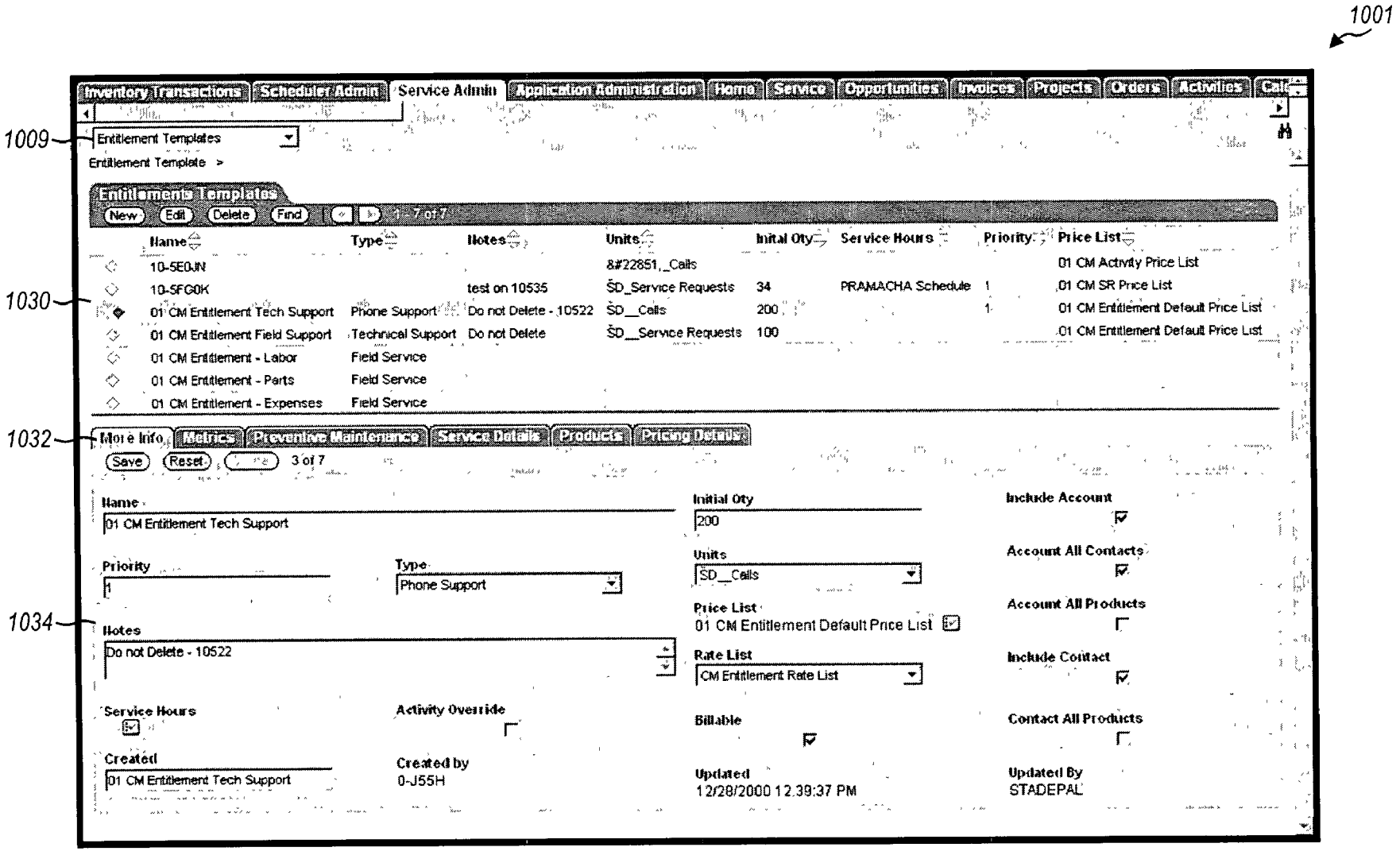

FIG. 10B shows a screen 1001 that may be used to create, edit, and manage templates for entitlements. Each entitlement template may be defined to include any type of entitlement, and the entitlement template may be incorporated a contract. Upon execution of the contract, the entitlements in the incorporated templates are instantiated into and become part of the contract, as described in the aforementioned U.S. patent application Ser. No. 10/299,265. Any number of entitlement templates may be defined and used for inclusion into contracts.

Screen 1001 shows an Entitlement Templates list applet 1030 that displays previously created and available entitlement templates using a list table. The list table includes a number of data rows, with each data row corresponding to a record for one entitlement template. The list table further includes a number of columns for a number of fields of each entitlement template. Table 3 lists various fields that may be defined for an entitlement template and the corresponding descriptions. Fewer, additional, and/or different fields may also be defined for an entitlement template, and this is within the scope of the invention.

TABLE 3

| Field | Description |
|---|---|
| Name | the name of the entitlement template (and also the entitlement) |
| Type | the entitlement type; may be selected from a list of Service, Warranty, Pricing, Field Service, Technical Support, Preventive Maintenance, Phone Support, Help Desk, Remote Support, Internet, Training, Subscriptions, Comprehensive, and so on |
| Priority | the user-assigned priority for the entitlement |
| Service Hours | a service calendar, if any, applicable for the entitlement |
| Units | the unit used to measure the entitlement (e.g., a telephone call, an on-site visit) |
| Initial Qty | the number of units covered by the entitlement (e.g., five calls, two on-site visits) |
| Price List | a Price List, if any, to be used for the entitlement |
| Rate List | a Rate List, if any, to be used for the entitlement |
| Billable | a flag to indicate whether certain charges and expenses may be billed for the entitlement |

A number of service calendars may be defined, and each service calendar may identify a particular time period during which entitlements maybe received (e.g., 9-5 normal business hours, 24/7, and so on). Similarly, a number of Price Lists (and Rate Lists) may also be defined, and each Price List (Rate List) may define a particular pricing (rate) structure for various benefits covered by the entitlement, such as services, parts, and so on. Entitlement creation and instantiation are described in further detail in the aforementioned U.S. patent application Ser. No. 09/967,895.

Screen 1001 also shows an Entitlement Detailed form applet 1034 that may be displayed for either a selected entitlement template (i.e., a specific template selected from among those shown in list applet 1030) or a new entitlement template. Entitlement Detailed form applet 1034 includes a number of tabs 1032 for a number of different "sub-views" that may be selected by the administrator/end-user. Each sub-view may be invoked to view and/or edit either general information for the entitlement or a particular entitlement component (e.g., "Metrics", "Preventive Maintenance", "Service Details", "Products", and "Pricing Details"). FIG. 10B shows an embodiment of the "More Info" sub-view used to provide information for the selected entitlement template.

Figure 10C:
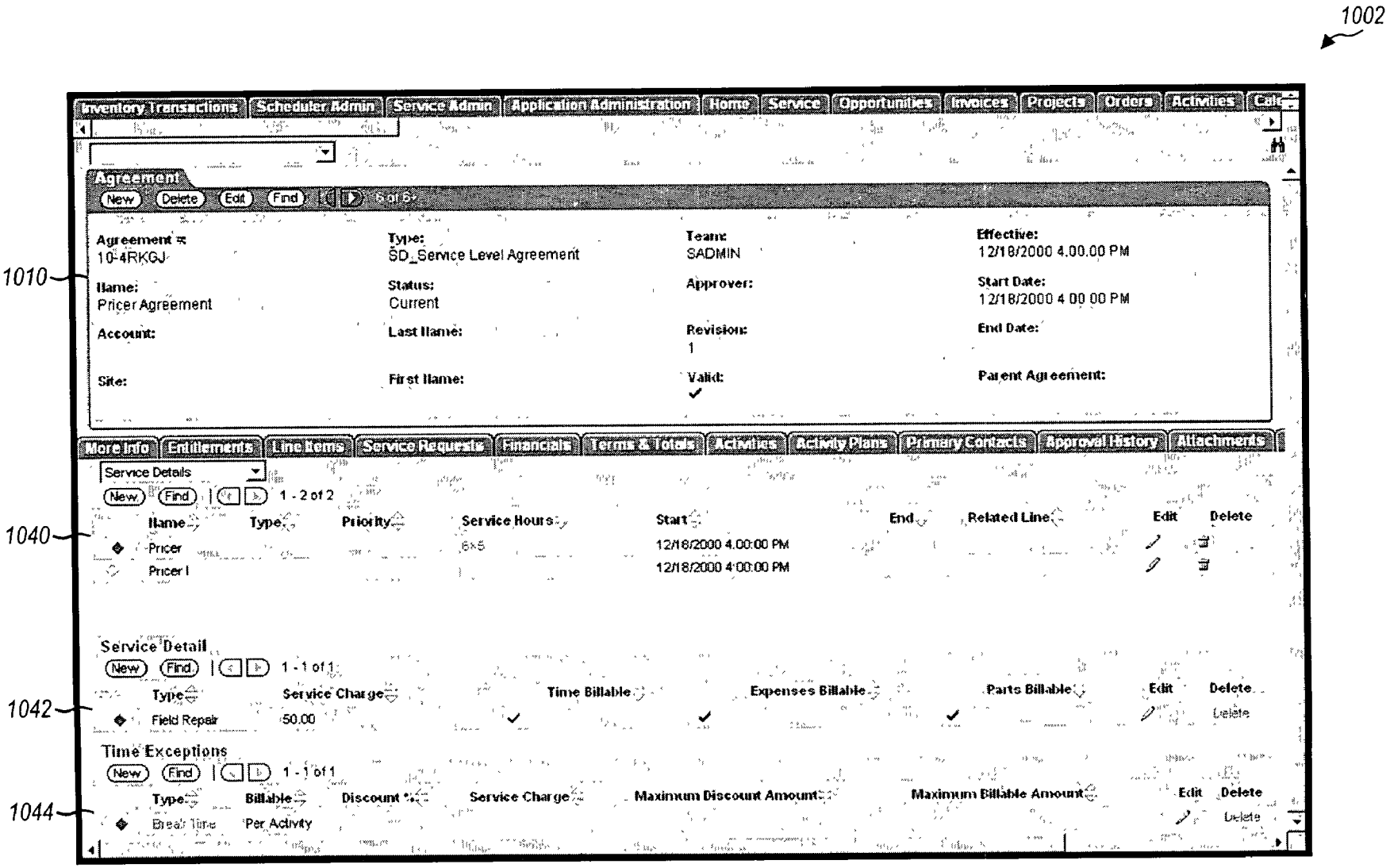

FIG. 10C shows a screen 1002 that may be used to view and define Service Details for a given entitlement. Screen 1002 shows an Entitlements list applet 1040, a Service Detail list applet 1042, and a Time Exceptions list applet 1044. A particular entitlement template may be selected in list applet 1040, and the Service Details information for the selected entitlement template is then provided in list applets 1042 and 1044.

Service Detail list applet 1042 includes a list table that displays all types of service activity covered by the selected entitlement template, one service activity type per data row in the list table. Various service activity types may be covered by a given entitlement template such as, for example, "Phone Support", "Field Repair", "Technical Support", "Preventive Maintenance", "Service", and so on.

Table 4 lists various fields that may be defined for a given service activity type in Service Detail list applet 1042 and the corresponding descriptions. Fewer, additional, and/or different fields may also be defined and are within the scope of the invention.

TABLE 4

| Field | Description |
|---|---|
| Service Charge | a service charge to be billed for each occurrence of the service activity |
| Time Billable | a flag to indicate whether or not the time spent for the service activity may be billed |
| Time Discount % | a discount to be applied to time charges |
| Maximum Time Discount | the maximum discount allowable for time charges for the service activity |
| Maximum Time Billed | the maximum that may be billed for time charges for the service activity |
| Expenses Billable | a flag to indicate whether or not the expenses incurred for the service activity may be billed |
| Expense Discount % | a discount to be applied to expenses |
| Maximum Expense Discount | the maximum discount allowable for expenses |
| Maximum Expense Billed | the maximum that may be billed for expenses |
| Parts Billable | a flag to indicate whether or not the parts used for the service activity may be billed |
| Parts Discount % | a discount to be applied to parts charges |
| Maximum Parts Discount | the maximum discount allowable for parts charges |
| Maximum Parts Billed | the maximum that may be billed for parts charges |

The Service Charge is the only charge for the service activity if the Time, Expenses, and Parts Billable flags are not checked and their Exceptions do not otherwise allow for other charges. If any one of these three flags is checked, then the Service Charge is additive to any other charges that may also be incurred.

The Time, Expense, and Parts Billable flags form the general rules for billing charges and expenses incurred for the service activity. If the Billable flag for a given activity item (i.e., time, expense, or parts) is set, then that activity item may be billable. And if the Billable flag for a given activity item is not set, then that activity item is not billed, unless specifically allowed for by the Exceptions for that activity item.

The Time, Expense, and Parts Discount % fields define the percentage discount to be applied for time, expense, and parts charges, respectively. For example, the entitlement may specify 15% discount for time, 50% discount for parts, and no discount for expenses. The percentage discount is computed from a price basis, which may be determined from the Price and/or Rate Lists included in the applicable contract or the activity's service request.

The Maximum Time, Expense, and Parts Discount fields define the maximum discount to be applied for time, expenses, and parts charges, respectively. For example, the entitlement may specify that the discount cannot exceed $100 for time charges and $50 for expenses.

The Maximum Time, Expense, and Parts Billed fields define the maximum amount that can be charged, per activity, for time, expense, and parts, respectively. For example, the entitlement may specify that the maximum amount that can be charged for time, per activity, is $1000.

Exceptions to the general rules for each service activity type may be defined via Time Exceptions, Expenses Exceptions, and Parts Exceptions list applets. The Time, Expense, and Parts Exceptions applets allow for customization of each service activity type covered by the entitlement template.

Time Exceptions list applet 1044 includes a list table that displays all exceptions for time expenses for a particular service activity type selected from among those shown in Service Detail list applet 1042. The list table in applet 1044 includes one time exception per data row and may be used to define various parameters for billing time charges. Table 5 lists various fields that may be defined for the Time Exceptions and the corresponding descriptions. Fewer, additional, and/or different fields may also be defined and are within the scope of the invention

TABLE 5

| Field | Description |
|---|---|
| Type | a type for time, which is selected from a pick list |
| Service Charge | a charge for this time type, which may be the only charge for time or may be additive to other charges for time |
| Billable | Yes - always billable<br>No - never billable<br>Default - unit for billing this time type (e.g., per activity, per incident) |
| Discount % | a discount to be applied to this time type |
| Maximum Discount Amount | the maximum discount for this time type |
| Maximum Billable Amount | the maximum charge for this time type |

The Expense Exceptions and Parts Exceptions applets may similarly be used to define various parameters for determining charges for expenses and parts, respectively, incurred for a service activity. The Parts Exceptions applet may also be used to define a price basis for computing the parts charges (e.g., a Cost, List, or Promotional price), the type of pricing to be applied to the price basis (e.g., a fixed discount amount, a discount percentage from the price basis, a mark-up amount, a mark-up percentage, or some other entered price).

In the example shown in FIG. 10C, "Field Repair" is the only service activity type covered by the entitlement. For the Field Repair, the fields in list applet 1042 are defined such that a service charge of $50 is billed for each occurrence of field repair, and charges for time, expenses, and parts may each be billed depending on how the Time, Expenses, and Parts Exceptions are defined.

Figure 10D:
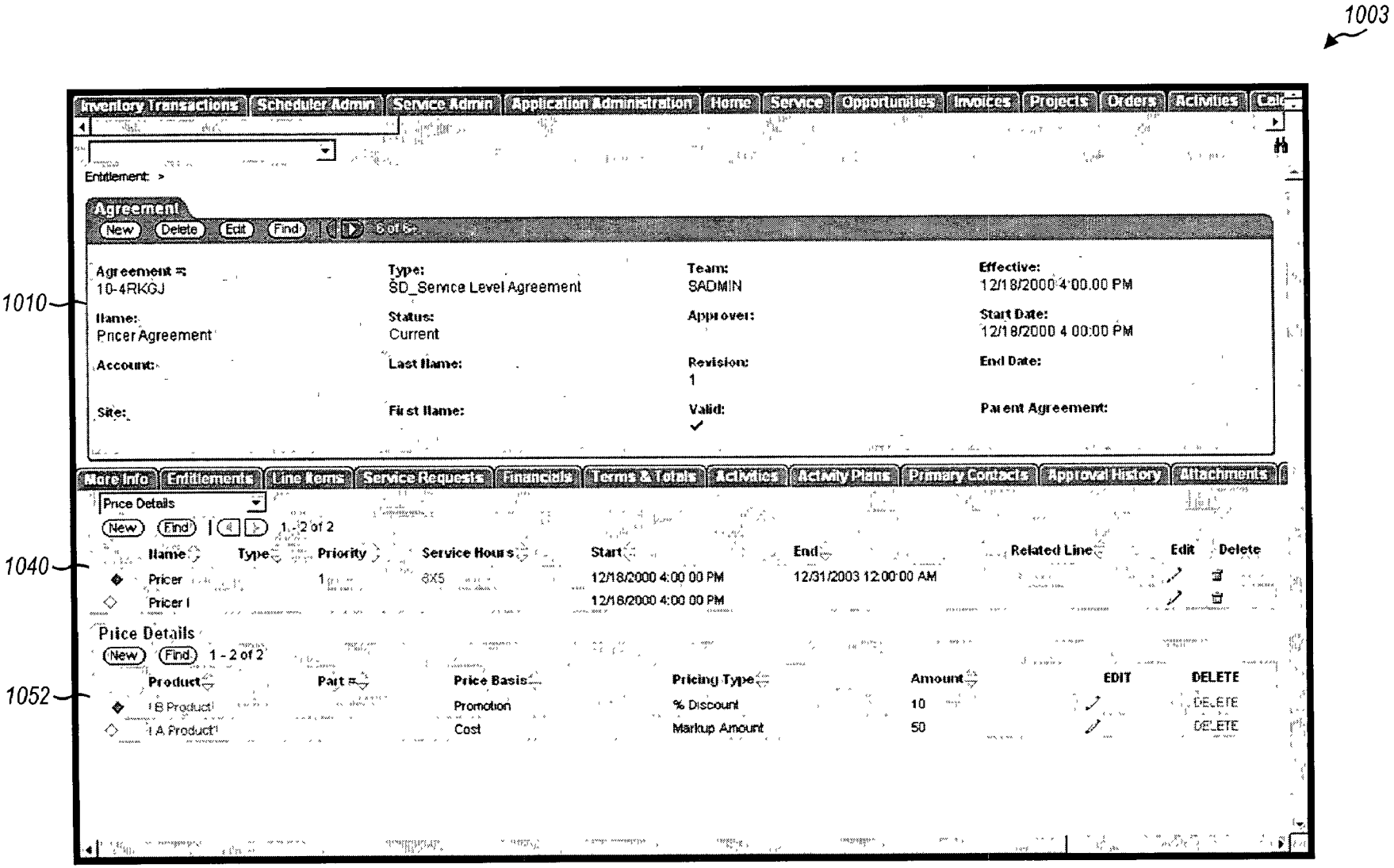

FIG. 10D shows a screen 1003 that may be used to view and define product pricing for a given entitlement. Screen 1003 includes Entitlements list applet 1040 and a Price Details list applet 1052. A particular entitlement template may be selected in list applet 1040, and the Price Details information for the selected entitlement template is then provided in list applet 1052.

Price Details list applet 1052 includes a list table that displays all products entitled to receive special pricing under the selected entitlement template, one product per data row in the list table. Each product may be associated with a particular pricing structure. Table 6 lists various fields that may be defined for the Price Details and the corresponding descriptions. Fewer, additional, and/or different fields may also be defined and are within the scope of the invention

TABLE 6

| Field | Description |
|---|---|
| Product | a product entitled to receive special pricing under the entitlement template |
| Part # | the part number for the product |
| Price Basis | a base price for the product from which adjustments, if any, are made; may be selected as either Cost, List, or Promotional |
| Pricing Type | a method for computing adjustments to the price basis; may be selected as either discount amount, discount percentage, mark-up amount, mark-up percentage, or a fixed price |
| Amount | the amount of adjustment to be applied to the price basis (in percent or dollar amount, e.g., 10% discount) |

Figure 10E:
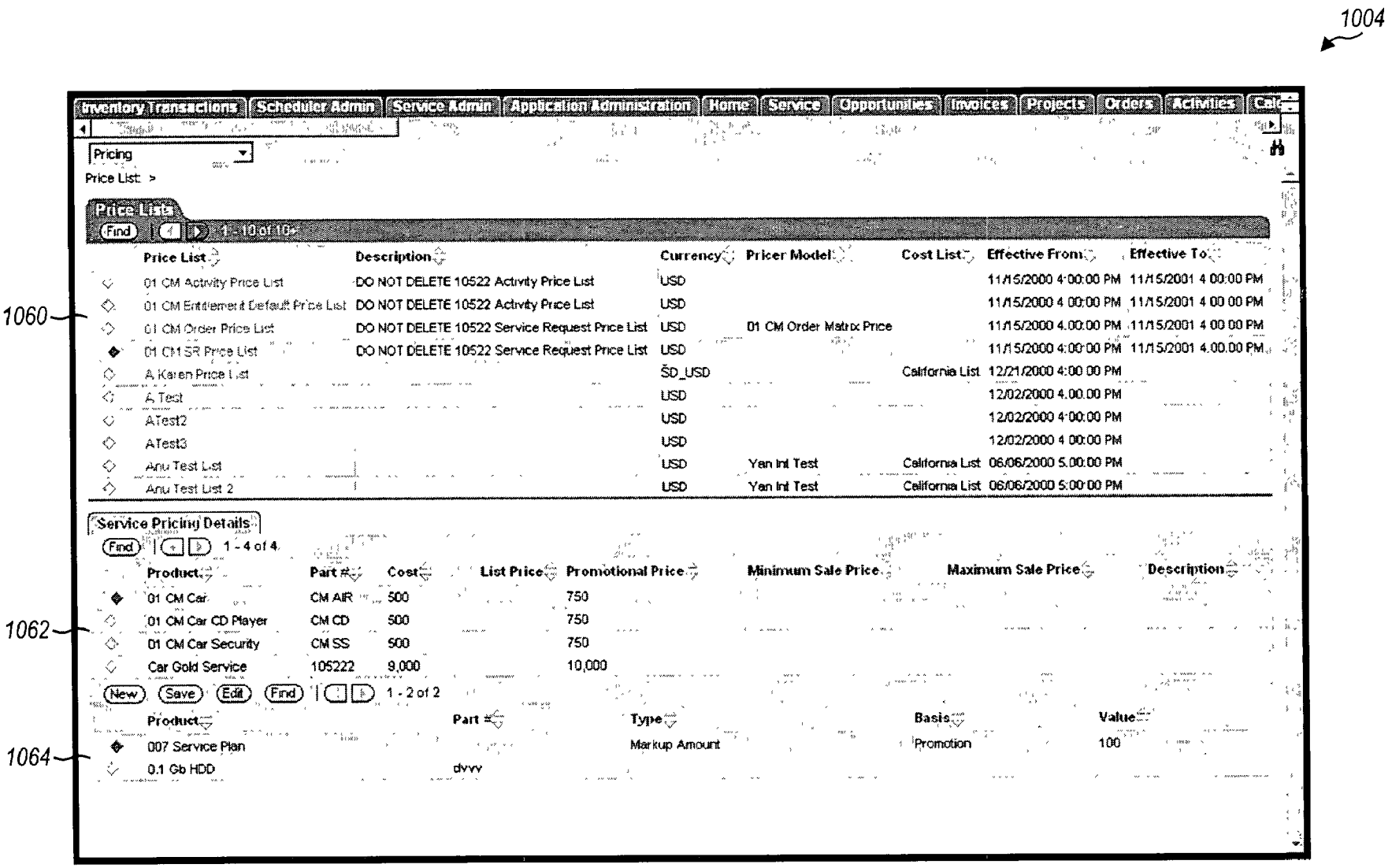

FIG. 10E shows a screen 1004 that may be used to create, edit, and manage Price Lists. Screen 1004 shows a Price Lists list applet 1060 that displays previously created and available Price Lists using a list table. The list table includes a number of data rows, with each data row corresponding to a record for one Price List. The list table further includes a number of columns for a number of fields of each Price List. Each Price List may be defined to include pricing terms for a particular product.

Screen 1004 also shows a Service Pricing Details list applet 1062 that displays a Service Pricing view, which allows an administrator and/or an end-user to associate multiple products that together define a unique price. This view enables the administrator/end-user entering a new agreement line item to specify a service product (e.g., Platinum Coverage) and to select an asset to be covered by the service (e.g., equipment G with serial number XYZ). The system will then return a price that is unique based on the combination of the service product and the covered asset.

In an embodiment, "asset-based" pricing is supported for the line items in an agreement. For a given agreement line item, the combination of a product (which is typically a service product) and an asset is associated with a unique price. Based on the product and asset in the agreement line item and the Price List associated with the agreement, the list price along with any volume discount information may be retrieved from the Price List. A Price List may also be defined to support different pricing for a combination of two products.

Figure 10F:
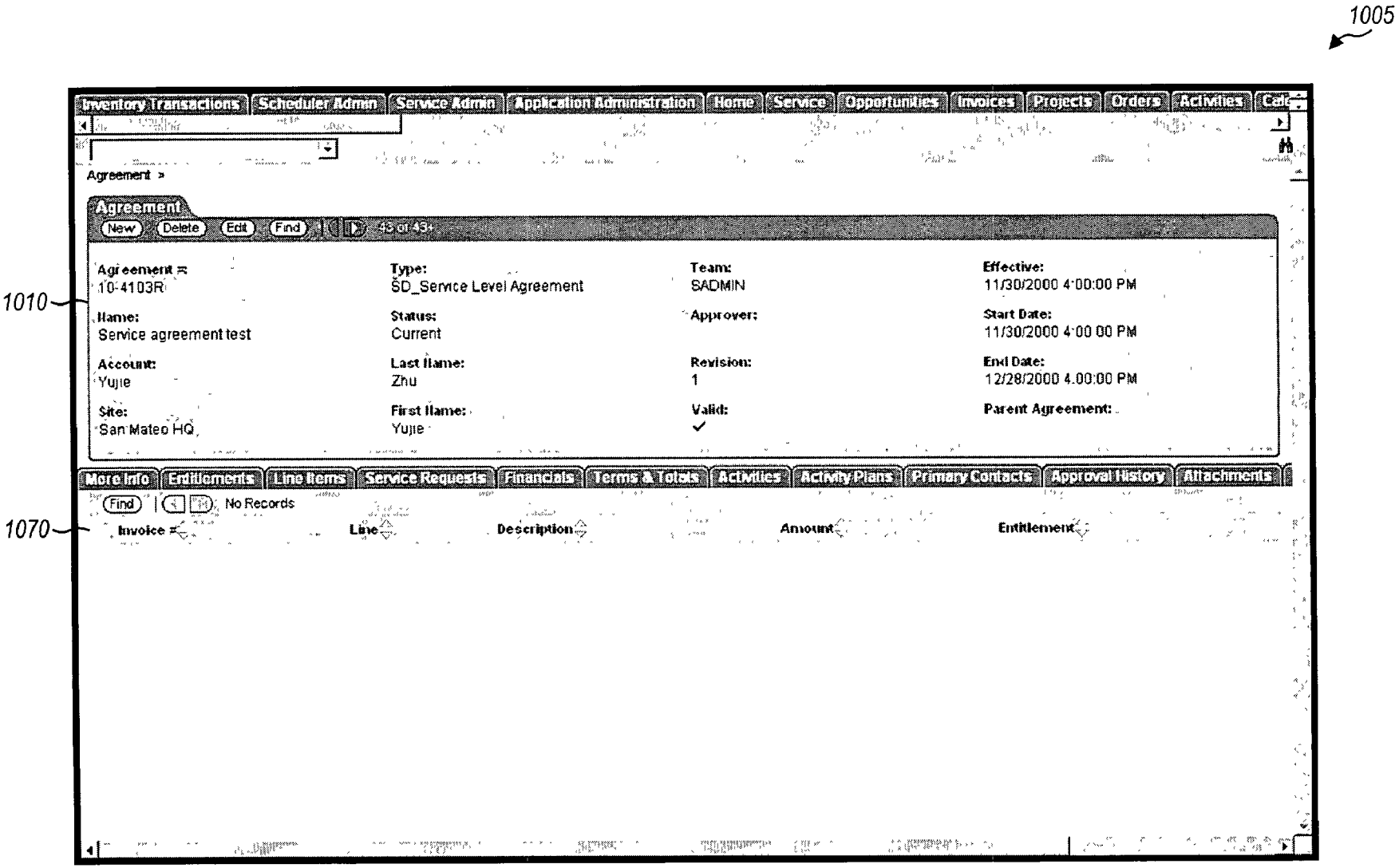

FIG. 10F shows an embodiment of a screen 1005 that may be used to display discounts. Screen 1005 includes Agreement form applet 1010 and a Discounts list applet 1070. Discounts list applet 1070 displays discounts applied on invoices generated for the specific agreement displayed in Agreement form applet 1010. Discounts list applet 1070 displays the discounts using a list table, with each data row of the table corresponding to a record for one discount.

Table 7 lists various fields that may be defined for the discount and the corresponding descriptions. Fewer, additional, and/or different fields may also be defined and are within the scope of the invention

TABLE 7

| Field | Description |
|---|---|
| Invoice # | the number of the invoice where the discount is applied |
| Amount | the discount amount |
| Description | a description for the discount |
| Entitlement | the name of the entitlement from which the discount is based |
| Totals | a total for the summation of the Amount field |

Figure 10G:
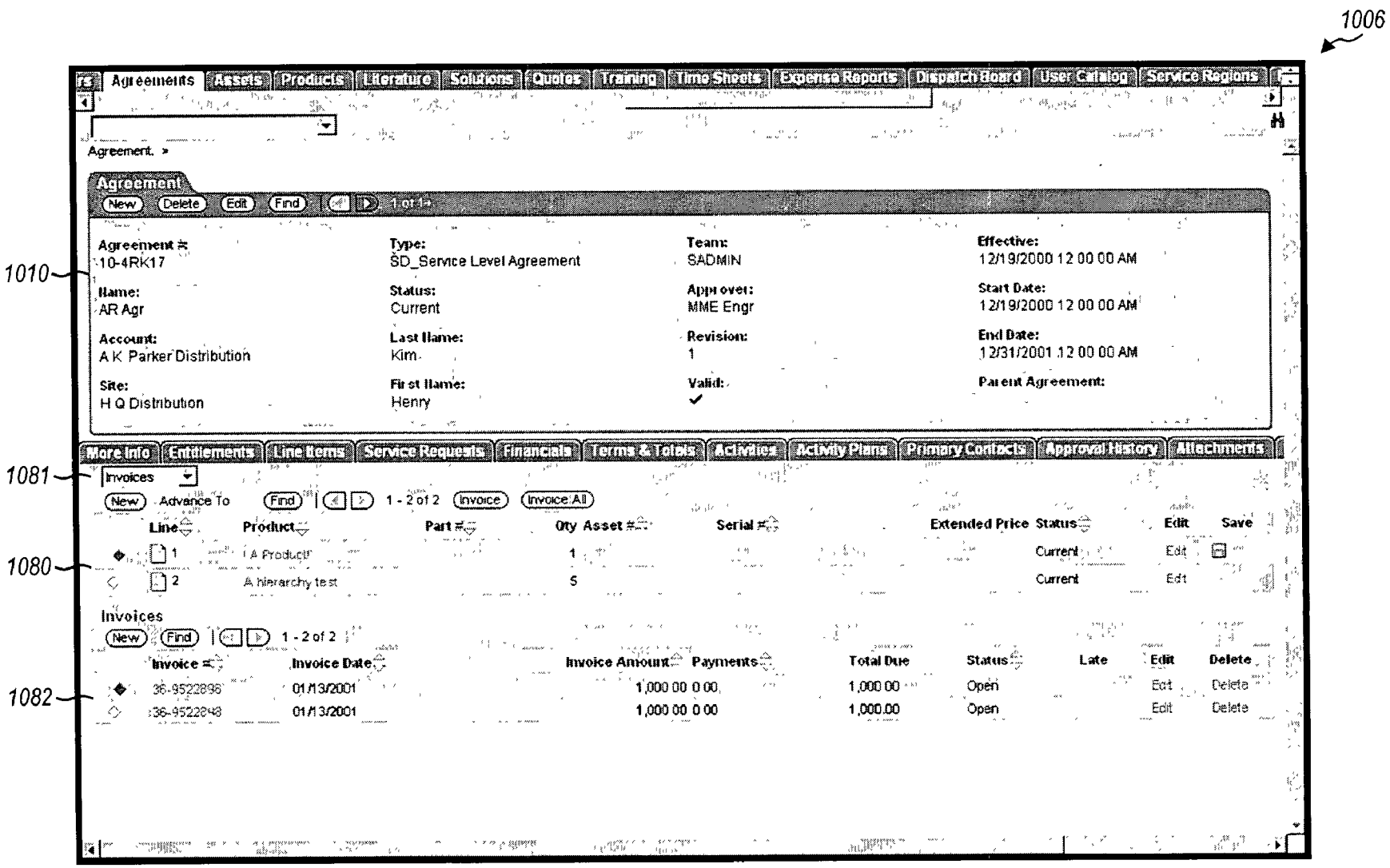

FIG. 10G shows an embodiment of a screen 1006 that may be used to display invoices generated using the techniques of the invention. Screen 1006 includes Agreement form applet 1010, a Line Items list applet 1080, and an Invoices list applet 1082 that may be invoked by selecting an "Invoices" choice in list box 1081. Line Items list applet 1080 is used to display all line items for a selected agreement using a list table, with each data row in the list table corresponds to a record for one agreement line item. Line Items list applet 1080 is described in further detail in the aforementioned U.S. patent application Ser. No. 09/967,862.

Invoices list applet 1082 displays the invoice line items for the selected agreement using a list table. Each data row in the list table corresponds to a record for one invoice line item. The list table includes columns for a number of fields of the invoice line items. Table 8 lists various fields that may be defined for the invoice and the corresponding descriptions.

TABLE 8

| Field | Description |
|---|---|
| Invoice # | a number assigned to the invoice |
| Invoice Date | the date the invoice was generated |
| Invoice Amount | total amount due for the invoice |
| Payments | total payment received for the invoice |
| Due Amount | amount still due for the invoice by the due date |
| Status | status of the invoice (e.g., "Open" or "Closed") |
| Late | indicate whether payment is late |
| Agreement ID | ID of the agreement from which the invoice was generated |
| Line item ID | ID of the agreement line item from which the invoice was generated |
| Product | the product description copied from the agreement line item |
| Payment Terms | price lists and payment terms (may be copied from the agreement) |
| Bill To | contact to which the invoice is addressed (may be copied from the agreement) |

An end-user may create invoices and may further manually add, delete, or modify the invoice records displayed in Invoices list applet 1082. In an embodiment, the "Invoice #" field in Invoices list applet 1082 may be used to ("drill down") invoke an Invoice form applet, which may be used to view and edit details of the selected invoice line item.

Figure 11:
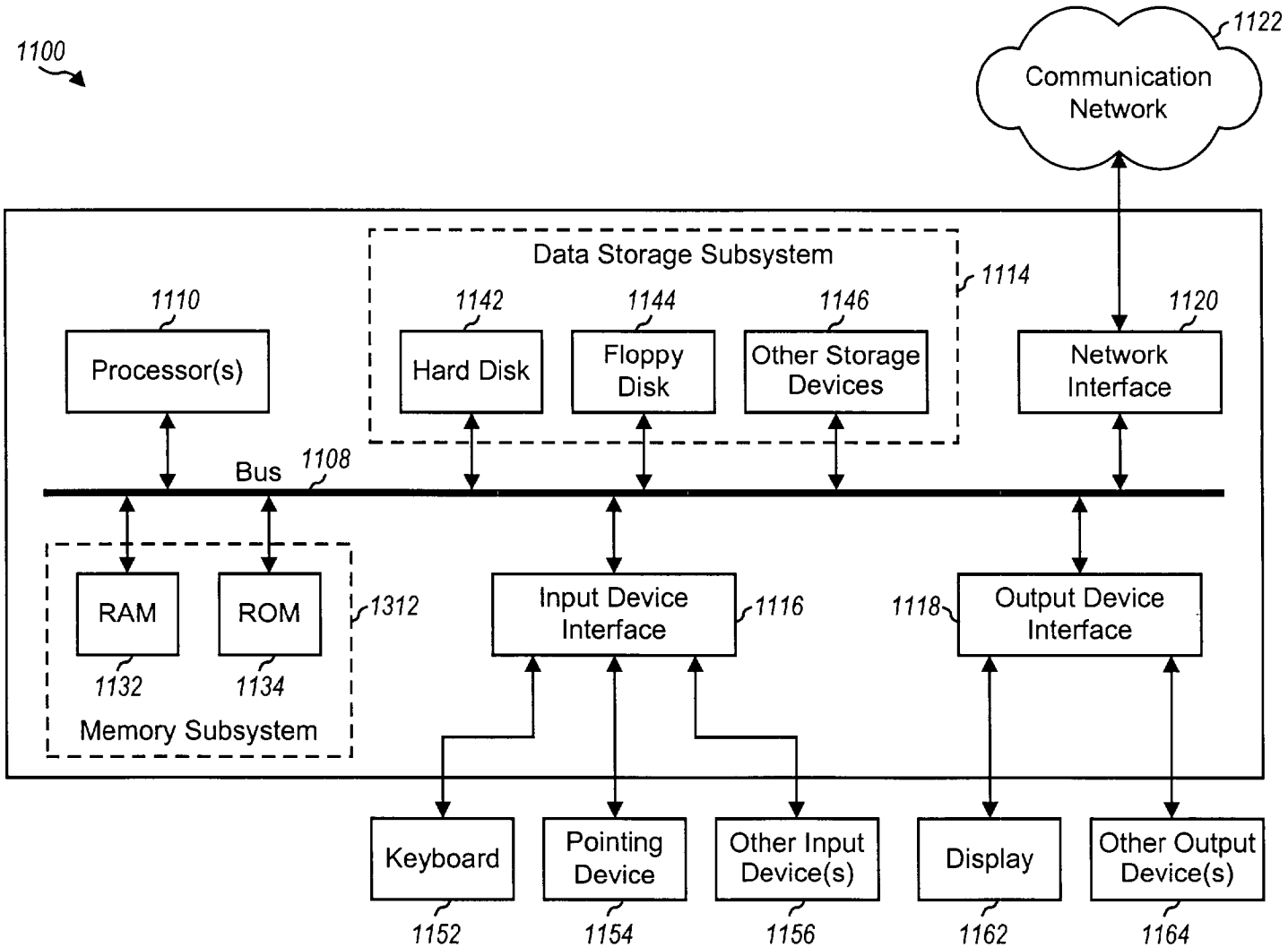
FIG. 11 is a block diagram of a computer system that may be used to implement the host server and client computers in FIG. 1.

FIG. 11 is a block diagram of an embodiment of a computer system 1100 that may be used to implement the host server and client computers in FIG. 1. As shown in FIG. 11, system 1100 includes a bus 1108 that interconnects major subsystems such as one or more processors 1110, a memory subsystem 1112, a data storage subsystem 1114, an input device interface 1116, an output device interface 1118, and a network interface 1120.

Bus 1108 provides a means for allowing various components and subsystems of system 1100 to communicate with each other. Many of the subsystems and components of system 1100 need not be at the same physical location but may be distributed at various locations throughout a communication network. Although bus 1108 is shown in FIG. 11 as a single bus, alternate designs for bus 1108 may include multiple busses.

Processor(s) 1110 perform many of the processing functions for system 1100 and communicate with a number of peripheral devices via bus 1108. Memory subsystem 1112 and data storage subsystem 1114 store the program codes and data that implement various aspects of the invention and further provide the functionality of system 1100. These program codes and data are then provided to memory subsystem 1112 and the codes are executed by processor(s) 1110. In a distributed environment, the program codes and data may be stored on a number of computer systems and used by the processors of these systems.

Memory subsystem 1112 typically includes a number of memories including a random access memory (RAM) 1132 and a read only memory (ROM) 1134. RAM 1132 is typically used to store codes and data during program execution and ROM 1134 is typically used to store fixed codes and data.

Data storage subsystem 1114 provides persistent (non-volatile) storage for program codes and data, and may include a hard disk drive 1142, a floppy disk drive 1144, and other storage devices 1146 such as a compact digital read only memory (CD-ROM) drive, an optical drive, and removable media cartridge disk drive. Each of the storage devices may be associated with removable media (e.g., floppy disks, CD- ROMs, cartridges). One or more of the storage devices may be located at remote locations and coupled to system 1100 via communication network 1122.

Input device interface 1116 provides interface with various input devices such as a keyboard 1152, a pointing device 1154 (e.g., a mouse, a trackball, a touch pad, a graphics tablet, a scanner, or a touch screen), and other input device(s) 1156. In general, the term "input device" is intended to include all possible types of devices and ways to input information into system 1100.

Output device interface 1118 provides an interface with various output devices such as a display 1162 and other output device(s) 1164. Display 1162 may be a cathode ray tube (CRT), a flat-panel device such as a liquid crystal display (LCD), or some other visual devices. In general, the term "output device" is intended to include all possible types of devices and ways to output information from system 1100 to a human or to another machine or computer systems.

Network interface 1120 provides an interface with outside networks including communication network 1122. Through network interface 1120, system 1100 is able to communicate with other computer systems coupled to network 1122. Network interface 1120 may provide a wireline or wireless interface to network 1122.

Many other devices or subsystems (not shown) may also be coupled to system 1100. In addition, it is not necessary for all of the devices shown in FIG. 11 to be present to practice the invention. Furthermore, the devices and subsystems may be interconnected in configurations different from that shown in FIG. 11. The operation of a computer system such as that shown in FIG. 11 is readily known in the art and not described in detail herein. The source codes to implement some embodiments of the invention may be operatively disposed in memory subsystem 1112 or stored on storage media such as a hard disk, a floppy disk, a CD-ROM that is operative with a CD-ROM player, or some other media.

The contract management system described herein may be implemented using a "thick-client" model whereby software modules for the contract management system are installed on both the host server and client computers. The contract management system described herein may also be implemented using a "thin-client" model whereby software modules for the contract management system are installed only on the host server, and the client computers can access data and functionality from the host server via browsers executed on the client computers. The browser-based thin-client model can provide various advantages over the thick-client model including (1) ease of installation, since the software modules for the thin-client model are typically only installed on the host server and not on the client computers, (2) ease of maintenance, since upgrades and other maintenance tasks are performed only on the host server, (3) high level of connectivity, since any user with a browser and (web) access may be able to interact with the host server, and other benefits.

FIG. 1 shows a specific operating mode whereby the contract manager and the invoicing engine are located at the host server. Other operating modes may also be supported and are within the scope of the invention. For example, some or all of the contract manager, the invoicing engine, and the associated data may be provided to a client computer, which may then perform various functions described herein (e.g., generate invoices with entitlements). Thus, the techniques described herein may be implemented in a "connected" mode (e.g., as shown in FIG. 1) or a "disconnected" mode wherein a client computer may be able to perform various functions, and the data (e.g., invoices) may thereafter be synchronized during a subsequent connection with the host server.

The foregoing description of the specific embodiments is provided to enable any person skilled in the art to make or use the present invention. Various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein, and as defined by the following claims.

What is claimed is:

1. A computer program product comprising a computer-usable medium having embodied therein computer-readable program codes to perform a method comprising identifying an event to be invoiced, wherein the event is associated with an identifier;

determining an original invoice amount for the event based on a first pricing scheme;

identifying an entitlement applicable for the event, which comprises matching the identifier with a contract associated with the entitlement, wherein the entitlement defines a second pricing scheme;

matching the event with an event covered by the entitlement, wherein each event covered by the entitlement is associated with a respective event price under the second pricing scheme;

determining a billable status of the event covered by the entitlement, wherein the billable status indicates the event price is one of billable and non-billable;

determining exceptions of the event covered by the entitlement, wherein each event covered by the entitlement is associated with at least one respective exception that defines an alternative event price that overrides the event price, and an alternative billable status that overrides the billable status;

determining a revised invoice amount for the event covered by the entitlement using the second pricing scheme, wherein the determining the revised invoice amount further comprises using the billable status and the exceptions according to parameters defined by the entitlement, wherein the parameters define when the alternative event price and the alternative billable status are used; and generating at least one invoice with one or more line items for the event.

2. The computer program product of claim 1, wherein the computer-usable medium is further embodied with computer-readable program codes for determining a discount for the event.

3. The computer program product of claim 2, wherein the discount for the event is determined based in part on the original or revised invoice amount for the event.

4. The computer program product of claim 1, wherein the original or revised invoice amount for the event includes a plurality of charges for a plurality of items for the event.

5. The computer program product of claim 1, wherein the computer-usable medium is further embodied with computer-readable program codes for determining adjustments, if any, to be made to the original or revised invoice amount for the event; and applying the adjustments to the original or revised invoice amount for the event.

6. The computer program product of claim 5, wherein the adjustments for the event specify a particular maximum invoice amount for the event.

7. The computer program product of claim 5, wherein the adjustments for the event specify a particular maximum discount amount for the event.

8. The computer program product of claim 1, wherein the second pricing scheme comprises an alternative pricing scheme to be used to determine the revised invoice amount for the event.

9. The computer program product of claim 8, wherein the alternative pricing scheme specifies an alternative price list or rate list different from those specified by the first pricing scheme.

10. The computer program product of claim 8, wherein the alternative pricing scheme specifies time and materials pricing.

11. The computer program product of claim 8, wherein the alternative pricing scheme specifies time, expense, and parts pricing.

12. The computer program product of claim 8, wherein the alternative pricing scheme specifies flat rate pricing.

13. The computer program product of claim 1, wherein the first pricing scheme specifies a particular price list or rate list, or both, to be used to determine the original invoice amount.

14. The computer program product of claim 1, wherein the event corresponds to a service activity.

15. The computer program product of claim 14, wherein the computer-usable medium is further embodied with computer-readable program codes for determining charges for time, expense, and parts for the event.

16. The computer program product of claim 15, wherein the time, expense, and parts charges for the event are determined based on time, expense, and parts exceptions defined for the event in the entitlement.

17. The computer program product of claim 14, wherein the computer-usable medium is further embodied with computer-readable program codes for determining a service charge, if any, for the event.

18. The computer program product of claim 1, wherein the event corresponds to an order pertaining to one or more products or assets, or a combination thereof.

19. The computer program product of claim 18, wherein the second pricing scheme comprises an alternative pricing scheme that specifies special pricing for the one or more products or assets in the event.

20. The computer program product of claim 1, wherein the entitlement is identified based in part on account and contact information.

21. The computer program product of claim 20, wherein the entitlement is further identified based on product information, asset information, or both.

22. A computer program product comprising a computer-usable medium having embodied therein computer-readable program codes to perform a method comprising identifying an event to be invoiced, wherein the event is associated with an identifier;

determining an original invoice amount for the event based on a first pricing scheme;

identifying an entitlement applicable for the event, which comprises matching the identifier with a contract associated with the entitlement, wherein the entitlement defines a second pricing scheme;

matching the event with an event covered by the entitlement, wherein each event covered by the entitlement is associated with a respective event price under the second pricing scheme;

determining a billable status of the event covered by the entitlement, wherein the billable status indicates the event price is one of billable and non-billable;

determining exceptions of the event covered by the entitlement, wherein each event is associated with at least one respective exception that defines an alternative event price that overrides the event price, and an alternative billable status that overrides the billable status;

determining a revised invoice amount for the event based on the second pricing scheme, wherein the determining the revised invoice amount further comprises using the billable status and the exceptions according to parameters defined by the entitlement, wherein the parameters define when the alternative event price and the alternative billable status are used;

determining a discount for the event; and generating at least one invoice for the event and having included therein the original invoice amount, the revised invoice amount, the discount, or a combination thereof.

23. In a computer system, a method comprising:

identifying an event to be invoiced, wherein the event is associated with an identifier;

determining an original invoice amount for the event based on a first pricing scheme;

identifying, using a processor, an entitlement applicable for the event, which comprises the at least one processor matching the identifier with a contract associated with the entitlement, wherein the entitlement defines a second pricing scheme;

matching the event with an event covered by the entitlement, wherein each event covered by the entitlement is associated with a respective event price under the second pricing scheme;

determining a billable status of the event covered by the entitlement, wherein the billable status indicates the event price is one of billable and non-billable;

determining exceptions of the event covered by the entitlement, wherein each event covered by the entitlement is associated with at least one respective exception that defines an alternative event price that overrides the event price, and an alternative billable status that overrides the billable status;

determining a revised invoice amount for the event, wherein the determining comprises the processor accessing the entitlement using the second pricing scheme, wherein the determining the revised invoice amount further comprises using the billable status and the exceptions according to parameters defined by the entitlement, wherein the parameters define when the alternative event price and the alternative billable status are used; and generating at least one invoice with one or more line items for the event.

24. The method of claim 23, further comprising:

determining a discount for the event.

25. The method of claim 23, further comprising:

determining adjustments, if any, to be made to the original or revised invoice amount for the event; and applying the adjustments to the original or revised invoice amount for the event.

26. The method of claim 23, wherein the event corresponds to a service activity.

27. The method of claim 26, further comprising:

determining charges for time, expense, and parts for the event.

28. In a computer system, a method comprising:

identifying an event to be invoiced, wherein the event is associated with an identifier;

determining an original invoice amount for the event based on a first pricing scheme;

identifying, using at least one processor, an entitlement applicable for the event, which comprises the at least one processor matching the identifier with a contract associated with the entitlement, wherein the entitlement defines a second pricing scheme;

matching the event with an event covered by the entitlement, wherein each event covered by the entitlement is associated with a respective event price under the second pricing scheme;

determining a billable status of the event covered by the entitlement, wherein the billable status indicates the event price is one of billable and non-billable;

determining exceptions of the event covered by the entitlement, wherein each event covered by the entitlement is associated with at least one respective exception that defines an alternative event price that overrides the event price, and an alternative billable status that overrides the billable status;

determining a revised invoice amount for the event based on the second pricing scheme, wherein the determining the revised invoice amount further comprises using the billable status and the exceptions according to parameters defined at least in part by the information stored in the entitlement, wherein the parameters define when the alternative event price and the alternative billable status are used;

determining a discount for the event; and generating at least one invoice for the event and having included therein the original invoice amount, the revised invoice amount, the discount, or a combination thereof.

29. A contract management system comprising:

a processor and a contract manager operative on the processor to:

identify an event to be invoiced, wherein the event is associated with an identifier;

determine an original invoice amount for the event based on a first pricing scheme;

identify an entitlement applicable for the event, wherein the entitlement is identified in part by matching the identifier with a contract associated with the entitlement, wherein the entitlement defines a second pricing scheme;

matching the event with an event covered by the entitlement, wherein each event covered by the entitlement is associated with a respective event price under the second pricing scheme;

determining a billable status of the event covered by the entitlement, wherein the billable status indicates the event price is one of billable and non-billable;

determining exceptions of the event covered by the entitlement, wherein each event covered by the entitlement is associated with at least one respective exception that defines an alternative event price that overrides the event price, and an alternative billable status that overrides the billable status;

determine a revised invoice amount for the event, wherein the revised invoice amount is determined in part by accessing the entitlement and using the second pricing scheme, wherein the determining the revised invoice amount further comprises using the billable status and the exceptions according to parameters defined by the entitlement, wherein the parameters define when the alternative event price and the alternative billable status are used; and generate at least one invoice with one or more line items for the event; and a local storage operatively coupled to the contract manager and configured to store a plurality of events, a plurality of entitlements, and the at least one invoice.

30. The contract management system of claim 29, wherein the contract manager is further operative to determine a discount for the event.

31. A computer program product comprising:

code for identifying an event to be invoiced, wherein the event is associated with an identifier;

code for determining an original invoice amount for the event based on a first pricing scheme;

code for identifying an entitlement applicable for the event, which comprises matching the identifier with a contract associated with the entitlement, wherein the entitlement defines a second pricing scheme;

code for matching the event with an event covered by the entitlement, wherein each event covered by the entitlement is associated with a respective event price under the second pricing scheme;

code for determining a billable status of the event covered by the entitlement, wherein the billable status indicates the event price is one of billable and non-billable;

code for determining exceptions of the event covered by the entitlement, wherein each event covered by the entitlement is associated with at least one respective exception that defines an alternative event price that overrides the event price, and an alternative billable status that overrides the billable status;

code for determining a revised invoice amount for the event, wherein the determining comprises accessing the entitlement and using the second pricing scheme, wherein the determining the revised invoice amount further comprises using the billable status and the exceptions according to parameters defined by the entitlement, wherein the parameters define when the alternative event price and the alternative billable status are used;

code for generating at least one invoice with one or more line items for the event; and a data storage medium configured to store the codes.

32. The computer program product of claim 31, further comprising:

code for determining a discount for the event.

* * * * *

UNITED STATES PATENT AND TRADEMARK OFFICE

CERTIFICATE OF CORRECTION

PATENT NO. : 8,386,345 B2
APPLICATION NO. : 10/299426
DATED : February 26, 2013
INVENTOR(S) : Tadepalli et al.

It is certified that error appears in the above-identified patent and that said Letters Patent is hereby corrected as shown below:

On Title page, in column 2, under "Other Publications", line 1, delete "subsciption" and insert -- subscription --, therefor.

On Title page, in column 2, under "Other Publications", line 4, delete "PR Newsire" and insert -- PR Newswire --, therefor.

In the Specification:

In column 5, line 19, delete "10/299,265," and insert -- 09/967,895, --, therefor.

In column 13, line 54, delete "10/299,265." and insert -- 09/967,895. --, therefor.

Signed and Sealed this
Second Day of July, 2013

Teresa Stanek Rea
*Acting Director of the United States Patent and Trademark Office*